US007824273B2

(12) United States Patent
Clapper et al.

(10) Patent No.: US 7,824,273 B2
(45) Date of Patent: Nov. 2, 2010

(54) CHILD MOTION DEVICE

(75) Inventors: Joshua E. Clapper, Exeter, PA (US); William B. Bellows, Wyomissing, PA (US); Matthew J. Ransil, Richland, PA (US); James E. Godiska, Exton, PA (US); David Saint, Elverson, PA (US); Nate Saint, legal representative, Mortantown, PA (US)

(73) Assignee: Graco Children's Products Inc., Exton, PA (US)

( * ) Notice: Subject to any disclaimer, the term of this patent is extended or adjusted under 35 U.S.C. 154(b) by 845 days.

(21) Appl. No.: 11/556,471

(22) Filed: Nov. 3, 2006
(Under 37 CFR 1.47)

(65) Prior Publication Data

US 2007/0267904 A1 Nov. 22, 2007

Related U.S. Application Data

(63) Continuation-in-part of application No. 11/385,260, filed on Mar. 20, 2006, now Pat. No. 7,563,170.

(60) Provisional application No. 60/732,643, filed on Nov. 3, 2005, provisional application No. 60/732,640, filed on Nov. 3, 2005.

(51) Int. Cl.
*A63G 13/00* (2006.01)
*A63G 9/16* (2006.01)

(52) U.S. Cl. ..... 472/95; 472/96; 472/119; 472/135

(58) Field of Classification Search ..... 472/95, 472/101, 103–105, 135, 118–125; 297/273–283
See application file for complete search history.

(56) References Cited

U.S. PATENT DOCUMENTS

| | | | | |
|---|---|---|---|---|
| 43,972 | A | 8/1864 | Coldwell | |
| 100,083 | A | 2/1870 | Stephan | |
| 616,697 | A | 12/1898 | Cowles et al. | |
| 1,360,495 | A | 11/1920 | Bugenhagen | |
| 1,707,167 | A | 3/1929 | Marshall | |
| 1,731,658 | A | 10/1929 | Gnuechtel | |
| 1,874,345 | A | 8/1932 | Parrott | |
| 2,173,300 | A * | 9/1939 | Heldman | 248/629 |

(Continued)

FOREIGN PATENT DOCUMENTS

| | | |
|---|---|---|
| DE | 2421474 | 11/1975 |

(Continued)

OTHER PUBLICATIONS

Fisher-Price Nature's Touch Baby Papasan Cradle Swing, Product # G2609, 2006; 2 pages; www.fisher-price.com.

(Continued)

*Primary Examiner*—Kien T Nguyen
(74) *Attorney, Agent, or Firm*—Lempia Braidwood LLC

(57) ABSTRACT

A child motion device has a frame assembly configured to rest on a floor surface. A support arm assembly is coupled to and cantilevered from part of the frame assembly above the floor surface. A child supporting device is supported by the support arm assembly. A bounce mechanism of the device is employed to reciprocally bounce the child supporting device above the floor surface.

22 Claims, 16 Drawing Sheets

U.S. PATENT DOCUMENTS

| | | | | |
|---|---|---|---|---|
| 2,371,384 | A | 3/1945 | Dyer, Jr. | |
| 2,506,890 | A | 5/1950 | Wilson | |
| 2,510,223 | A | 6/1950 | Hart | |
| 2,616,485 | A | 11/1952 | Robbins | |
| 2,704,111 | A | 3/1955 | Wunderlich | |
| 3,147,972 | A | 9/1964 | Borusk | |
| 3,391,932 | A | 7/1968 | Scalf | |
| 3,829,086 | A | 8/1974 | Lelong | |
| 4,155,548 | A | 5/1979 | Smith et al. | |
| 4,226,467 | A | 10/1980 | Boudreau | |
| 4,258,446 | A | 3/1981 | McAllister | |
| 4,620,334 | A | 11/1986 | Robinson | |
| 4,805,902 | A | 2/1989 | Casagrande | |
| 4,911,499 | A | 3/1990 | Meeker | |
| 5,303,433 | A | 4/1994 | Jang | |
| 5,403,239 | A | 4/1995 | Zimmers | |
| 5,451,093 | A | 9/1995 | Petrie et al. | |
| 5,531,645 | A * | 7/1996 | Collins | 472/97 |
| 5,547,425 | A * | 8/1996 | Krhs et al. | 472/110 |
| 5,688,211 | A | 11/1997 | Myers | |
| 5,707,294 | A | 1/1998 | Fischer | |
| 5,803,817 | A | 9/1998 | Stern | |
| 5,833,545 | A | 11/1998 | Pinch et al. | |
| 6,027,409 | A | 2/2000 | Favorito et al. | |
| 6,254,490 | B1 | 7/2001 | Lawson et al. | |
| 6,318,803 | B1 | 11/2001 | Garland | |
| 6,343,994 | B1 | 2/2002 | Clarke | |
| 6,533,672 | B1 * | 3/2003 | Keller et al. | 472/110 |
| 6,574,806 | B1 | 6/2003 | Maher | |
| 6,811,217 | B2 | 11/2004 | Kane et al. | |
| 6,854,799 | B1 | 2/2005 | Asbach et al. | |
| 6,932,709 | B1 | 8/2005 | Gubitosi et al. | |
| 2002/0113469 | A1 | 8/2002 | Stern et al. | |
| 2005/0101219 | A1 | 5/2005 | Paesang et al. | |
| 2006/0012230 | A1 | 1/2006 | Kennedy et al. | |
| 2007/0040431 | A1 | 2/2007 | Bapst et al. | |

FOREIGN PATENT DOCUMENTS

| | | |
|---|---|---|
| DE | 3834934 | 4/1990 |
| GB | 1 163 624 | 9/1969 |
| GB | 2 312 374 | 10/1997 |
| JP | 48068367 | 9/1973 |
| JP | 60014819 | 1/1985 |
| WO | WO 03/079861 | 10/2003 |
| WO | WO 2006/096712 | 9/2006 |

OTHER PUBLICATIONS

International Search Report and Written Opinion issued on Apr. 11, 2007 in International Application No. PCT/US2006/060525.
English language translation of JP 48-68367.
English language translation of DE 2421474.

* cited by examiner

CHILD MOTION DEVICE

RELATED APPLICATION DATA

This patent is related to and claims priority benefit of U.S. Provisional Patent Application Ser. Nos. 60/732,640 (Child Swing) and 60/732,643 (Child Activity Center), which were filed on Nov. 3, 2005. This patent is also a continuation-in-part of U.S. patent application Ser. No. 11/385,260, which was filed on Mar. 20, 2006 now U.S. Pat. No. 7,563,170 and also entitled "Child Motion Device." The entire contents of both the prior filed provisional applications and the parent application are incorporated herein by reference.

BACKGROUND OF THE INVENTION

1. Field of the Disclosure

The present disclosure is generally directed to child motion devices, and more particularly to a device for supporting a child and imparting at least a reciprocating bounce motion to the child.

2. Description of Related Art

Child motion devices such as conventional pendulum swings and infant bouncer seats are known in the art. These types of devices are often used to entertain and, sometimes more importantly, to sooth or calm a child. A child is typically placed in a seat of the device and then the device is used to swing the child in a reciprocating pendulum motion. In the case of a typical bouncer, a child is placed in the seat, which is supported by a flexible wire frame. The child's own movement or movement from external force applied to the seat by a caregiver results in relatively high frequency oscillating movement of the child. The bouncing movement has typically a vertical component and as well as a horizontal component based on the frame configuration.

Research has shown that many babies or children are not soothed or calmed down by these types of motion, but that these same children may be more readily calmed or soothed by motion imparted by a parent or adult holding the child. Parents often hold their children in their arms and in front of their torso and move in a manner that is calming and/or soothing to the child. Such movements can include side-to-side rocking, light bouncing up and down, or light rotational swinging as the parent either swings their arms back and forth, rotates their torso from side-to-side, or moves in a manner combining these motions.

Many types of child motion devices are known that are not readily and compactly foldable for storage or stowing away. Also, currently known child motion devices do not typically enable multiple different optional seating positions and arrangements for the child or optional motion characteristics. A typical child motion device has only a single seating orientation and a single motion characteristic that can be provided for a child placed in the seat. A number of these types of devices are motorized to impart automatic and continuous movement to the child seat. These devices typically mount the motor above the head of a child within the device. The motor can be a noisy nuisance for the child. Additionally, the drive takes up space above the seat, which can make it difficult for an adult to position a child in the device.

Another common disadvantage of known child motion devices is that they typically are not configured to adapt for continued use as a child grows. Most devices are designed for children within a specific, relatively narrow age window and size range. When a child outgrows a device, the device is often stowed away and no longer used, taking up significant storage space within the home. Alternatively, the device may be given away or handed off to another family. A given family will typically not get a lot of use out of such a device before they no longer have a need for the device. Thus, the value to a family of these types of child motion products can be diminished.

Some types of child motion devices are known that attempt to address one or more of the above-noted problems and disadvantages, including alternative motion devices. For example, Fisher-Price manufactures a pendulum swing with a motor above the child's head. The seat of the swing can be oriented in one of two optional seat facing directions by rotating the suspended pendulum-type swing arm through a 90 degree angle. Also, U.S. Pat. No. 6,811,217 discloses a child seating device that can function as a rocker and has curved bottom rails so that the device can simulate a rocking chair. U.S. Pat. No. 4,911,499 discloses a motor driven rocker with a base and a seat that can be attached to the base. The base incorporates a drive system that can move the seat in a rocking chair-type motion. U.S. Pat. No. 4,805,902 discloses a complex apparatus in a pendulum-type swing. The swing's seat moves in a manner such that a component of its travel path includes a side-to-side arcuate path in a somewhat horizontal plane (see FIG. 9 of the patent). U.S. Pat. No. 6,343,994 discloses another child swing wherein the base is formed having a first stationary part and a second part that can be turned or rotated by a parent within the first part. The seat swings in a conventional pendulum-like manner about a horizontal axis and a parent can rotate the device within the stationary base part to change the view of the child seated in the seat.

BRIEF DESCRIPTION OF THE DRAWINGS

Objects, features, and advantages of the present invention will become apparent upon reading the following description in conjunction with the drawing figures, in which.

DETAILED DESCRIPTION OF THE DISCLOSURE

A number of examples are disclosed herein of child motion devices for soothing, calming, and/or entertaining children. The disclosed child motion devices solve or improve upon one or more of the above noted and other problems or difficulties with respect to known child motion devices. The disclosed child motion devices each broadly incorporate a frame assembly and one or more bouncing or generally vertically oscillating support arms. In one example, a child seat or other child supporting device can be carried by the support arm or arms and can oscillate in a generally vertical reciprocating movement. In another example, the vertical movement of the arm or arms can be employed in combination with a generally horizontal orbital movement or arcuate path. The optional orbital movement can lie in a plane that is parallel to a reference plane defined by a floor surface or that is tilted or angled slightly relative to the reference plane. In one disclosed example, the support arm or arms have a driven end coupled to a drive system that can reciprocally move the support arm vertically, through its orbital travel path, or both.

In one example, the distal or free end of the support arm or arms are configured to accept and support the child seat or other device above the ground surface. In one example, the support arm or arms can include a child seat holder that cooperates with the child seat to permit setting the child seat on the child motion device in more than one optional seat position and orientation. In this way, a child seated in the seat can experience a variety of different motions. In another example, the seat holder can be specifically configured to accept and support a seat or other child carrying device from another product, such as a car seat, an infant carrier, a sling seat assembly, a hobby horse, or the like.

The terms generally, substantially, and the like as applied herein with respect to vertical and horizontal orientations and directions are intended to mean that the components have a primarily vertical or horizontal orientation, but need not be precisely vertical or horizontal in orientation. The components can be angled to vertical or horizontal, but not to a degree where they are more than 45 degrees away from the reference mentioned. In many instances, the terms "generally" and "substantially" are intended to permit some permissible offset, or even to imply some intended offset, from the reference to which these types of modifiers are applied herein.

Figure 1:
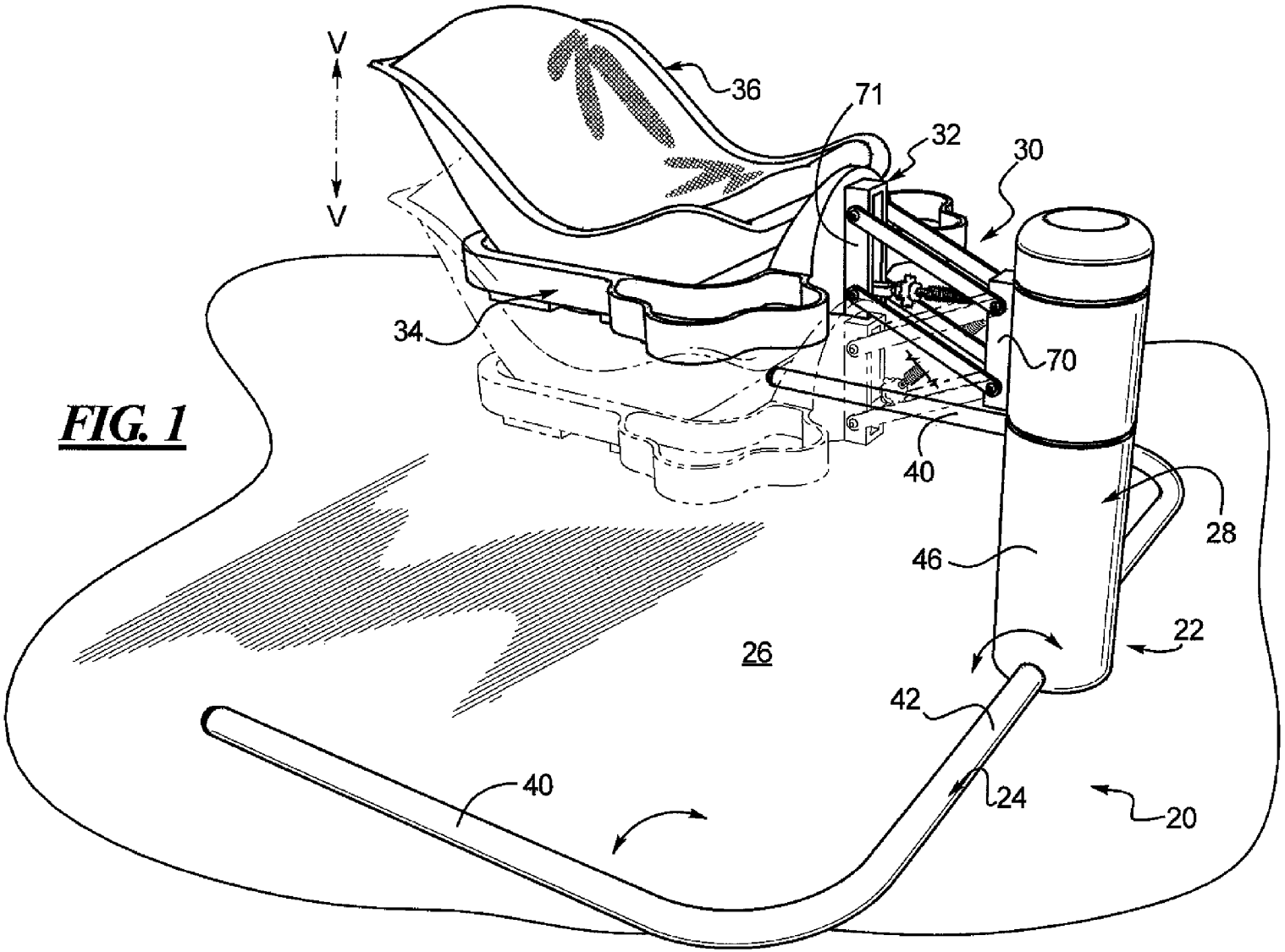
FIG. 1 is a perspective view of one example of a child motion device constructed in accordance with the teachings of the present invention.

Turning now to the drawings, FIG. 1 shows one example of a child motion device 20 constructed in accordance with the teachings of the present invention. The device 20 in this example generally has a frame assembly 22 with a base 24 that is configured to rest on a floor surface 26. Throughout this detail description, the term "floor surface" is utilized to define both a surface on which the devices rest when in the in-use configuration and a reference plane for comparison to other aspects and parts of the invention for ease of description. However, the invention is not intended to be limited to use with only a specifically horizontal orientation of either the base of its frame assembly or the reference or floor surface. Instead, the floor surface and the reference plane are utilized to assist in describing relationships between the various components of the device 20.

The child motion device 20 shown in FIG. 1 also has an upright riser, post, or spine 28 that extends upward from a part of the base 24. In this example, the spine 28 is oriented in a generally vertical orientation relative to its longitudinal length. Any of the spines disclosed herein can have a housing or cover configured in any desired or suitable manner. The housing can be ornamental, functional, or both. The cover can also be removable to access the inner workings of the device if needed. The spine can vary considerably in orientation, shape, size, configuration, and the like from the examples disclosed herein.

In this example, a support arm assembly 30 is cantilevered from the spine 28 and extends generally outward in a radial direction from the spine. Support arm assembly 30 in this example is mounted and configured for generally vertical oscillating motion. As described below, the support arm assembly 30 can also be optionally mounted for pivotal, side-to-side movement about a driven end at the spine 28 through a travel path that is substantially horizontal. In such an example, the support arm assembly 30 can also travel through a partial orbit or arc segment of a predetermined angle and can rotate about an axis of rotation R, which can be offset from a vertical reference and which can be offset from an axis of the spine. Alternatively, the axis of rotation can be aligned with the vertical reference, the axis of the spine, or both if desired. The driven end can be coupled to a drive system as described below and designed to reciprocate or oscillate the support arm assembly 30 in the vertical oscillating motion, the horizontal orbiting motion, or both.

In this example, the support arm assembly 30 has a distal end 32 that carries a seat holder 34 that is configured to support a child seat or infant carrier 36 or the like for movement with the support arm assembly. Particular details of the holder, the seat, and other options that can replace the seat are discussed below. The various components of the child motion device 20 shown in FIG. 1 and the various alternative embodiments of child motion devices described herein can vary considerably and yet fall within the spirit and scope of the present invention. A small number of examples are disclosed herein to illustrate the nature and variety of component configurations.

In the example of FIG. 1, the base 24 of the frame assembly 22 is a U-shaped structure with a pair of elongate legs 40 that extend generally parallel to one another and are interconnected at one end by a traversing link 42. In this example, the frame assembly 22 lies flat on the floor surface 26. The structure is sized to provide a stable base for the device 20 when in use. The configuration of the base 24 can vary from the U-shaped shown in FIG. 1 as discussed later. The base 24 is positioned so that it is generally beneath the seat holder 34 and the child seat 36 or other child supporting device in a manner to offset the load or moment applied to the spine 28 when the child is placed in the seat 36. Arrows C in FIG. 1 illustrate that the frame assembly can be configured to fold up or collapse from the in-use position as shown to a collapsed configuration for storage or transport. The collapsibility feature is discussed in greater detail below. In this example, the spine 28 and frame assembly base 24 can be configured to fold from the in-use position to a flat configuration. The support arm assembly 30 can also be configured to fold or collapse as well.

Figure 2A:
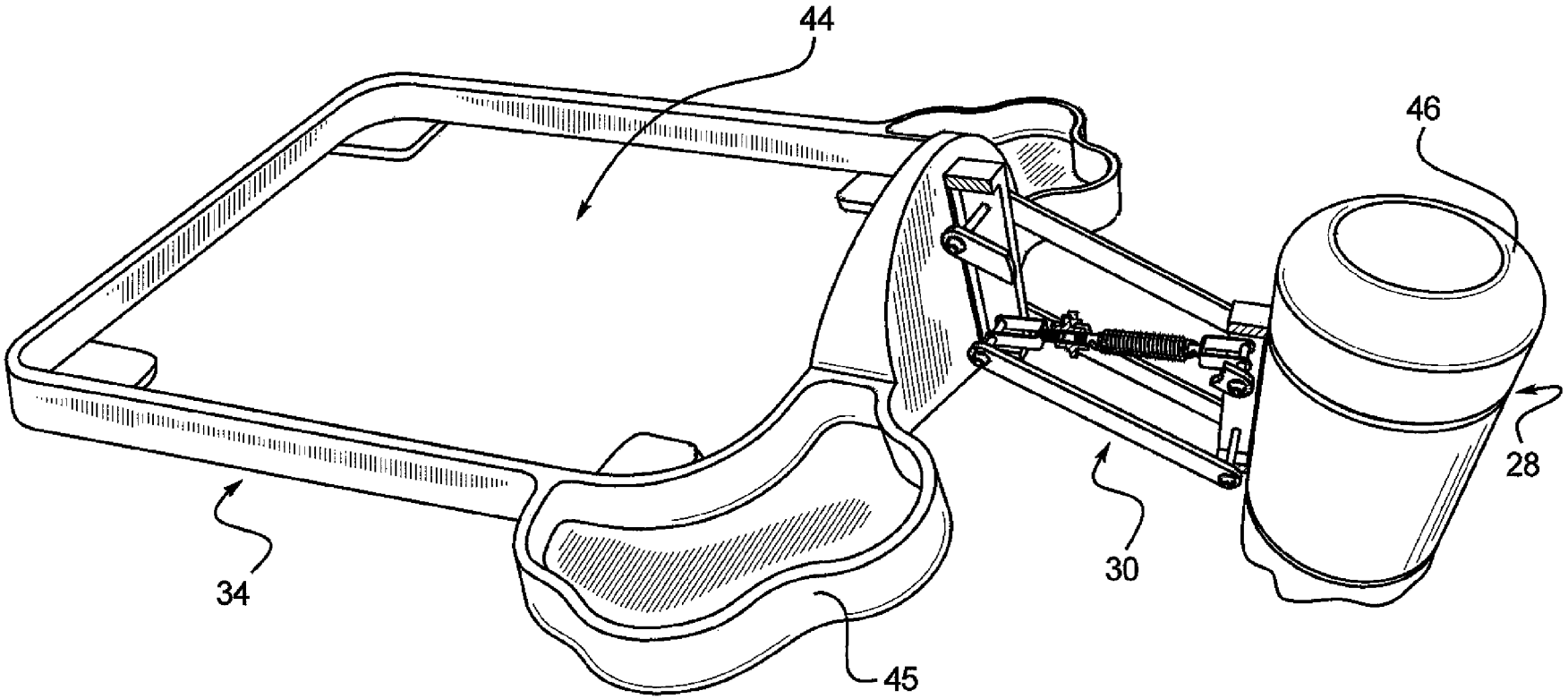
FIG. 2A is a fragmentary view of the seat holder part of the child motion device shown in FIG. 1.

Similarly, the configuration and construction of the seat holder 34 can also vary considerably from the examples shown and described herein. As shown in FIG. 2A, the seat holder 34 in this example is generally a square or rectangular ring of material that surrounds an opening 44. The configuration of the ring, the opening, and the bottom of the seat or other structure can vary to accommodate easy installation and removal of the seat or other device on the holder. In one example, the seat or holder can be configured to permit the child seat 36 or other device to be mounted on the support arm in a number of optionally different orientations. For example, the components can be configured so that the seat 36 can be inserted on the holder 34 with the occupant facing the spine, away from the spine, or in either side direction relative to the spine. Though not shown herein, the array of optional child orientations allow the child to experience different relative motions and a variety of different visual environments without changing the nature of the child motion device 20. The seat holder 34 or the seat can also be provided with peripheral features such as optional storage, toy bars, toy mounts, and the like. FIG. 1 shows an optional storage tray 45 on each of two corners of the holder 34.

Figure 2B:
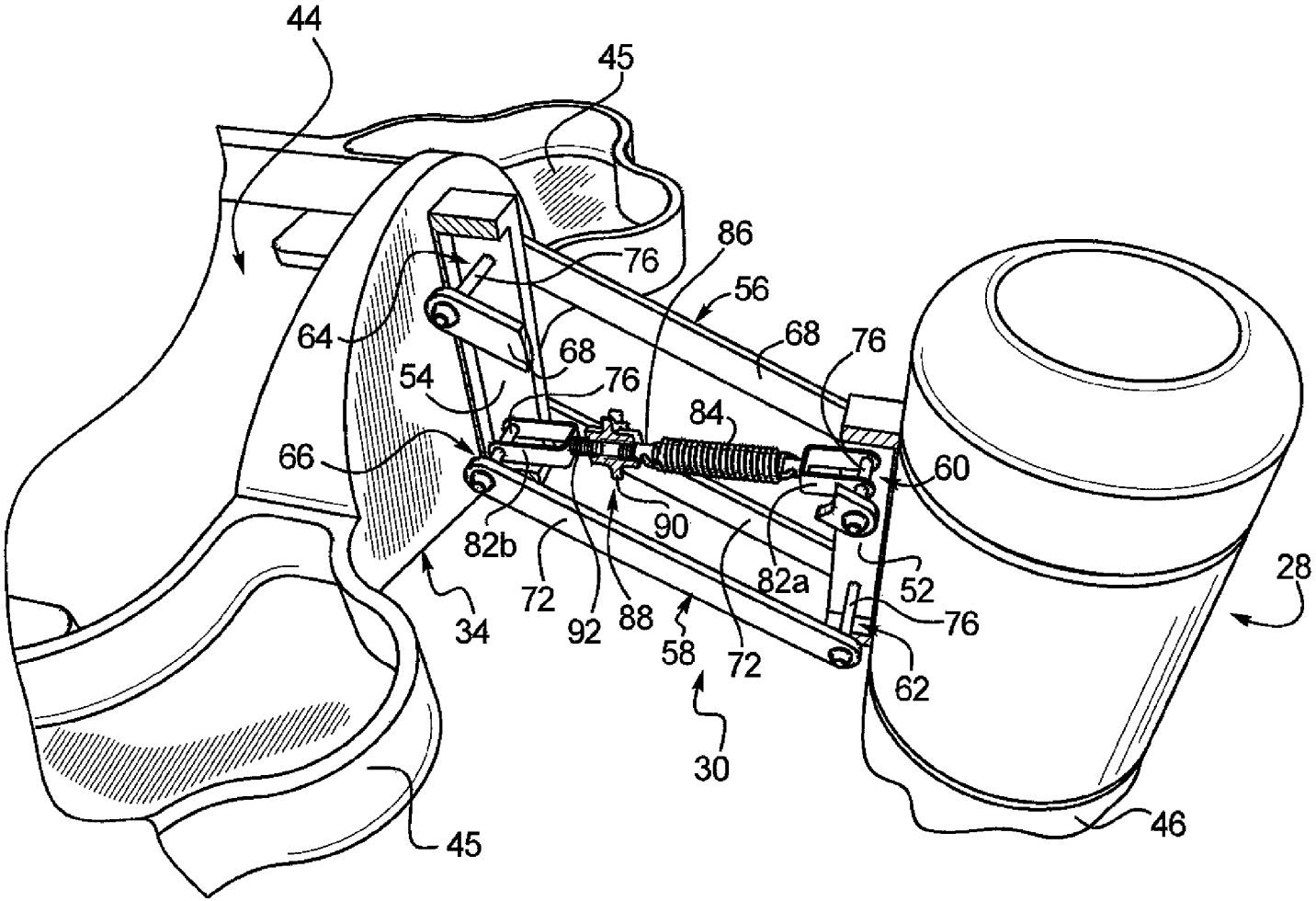
FIG. 2B is an enlarged view of a portion of the child motion device shown in FIG. 1 that can impart a bounce motion to the child.
Figure 3:
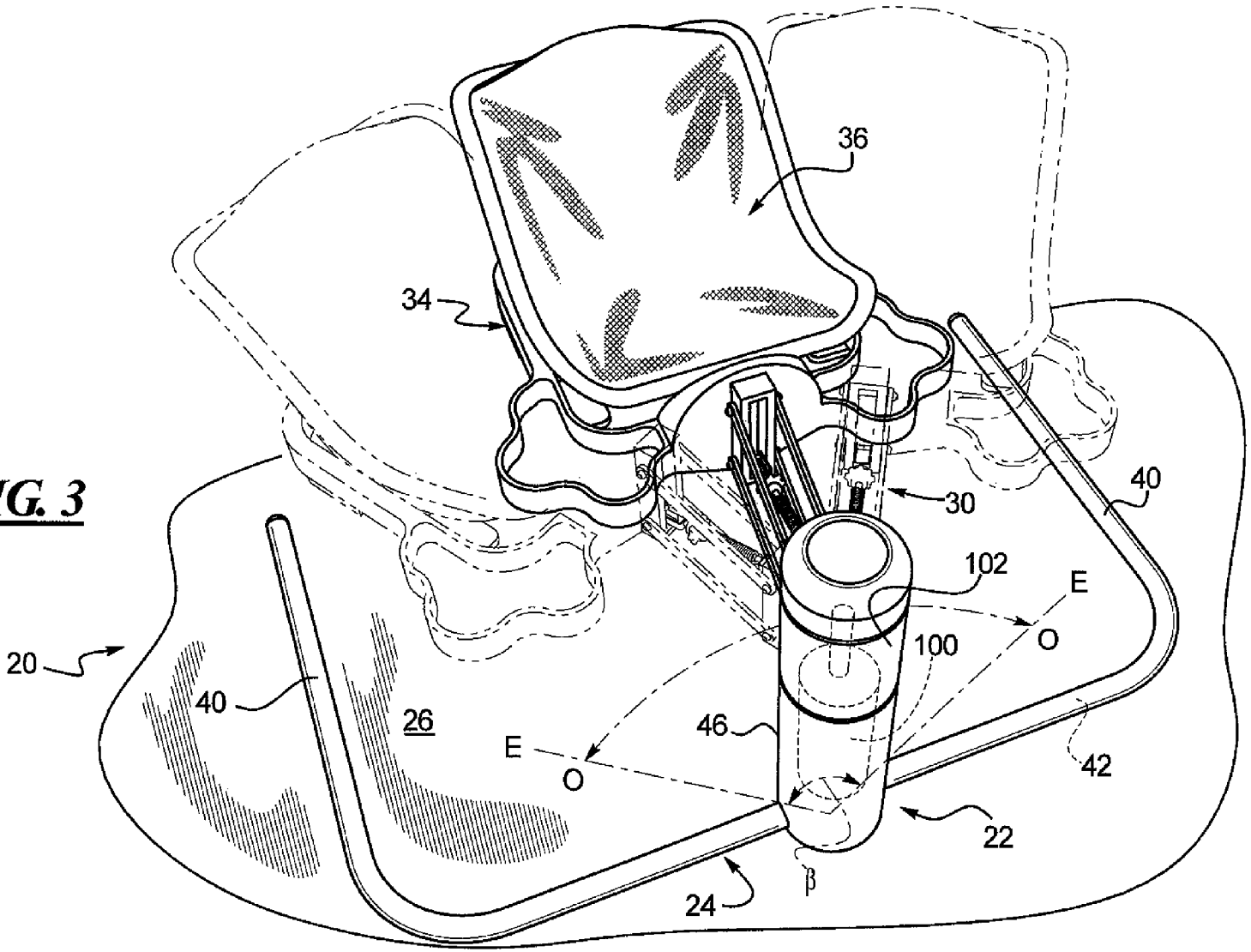
FIG. 3 is a top elevation view of the child motion device shown in FIG. 1 and depicting an optional orbit motion that can be imparted to the child.

As shown in FIGS. 1-3, the device 20 is configured to provide at least a vertical oscillating motion and to impart that motion to the child seat 36 or other child supporting structure on the support arm assembly 30. The support arm assembly 30 in the disclosed example of FIGS. 1-3 includes a linkage assembly in a four-bar linkage arrangement. In this example, the linkage assembly includes a fixed ground or frame link 52 carried on the spine 28. The frame link 52 is generally vertically oriented and, in this example, is formed as a part of a cover or housing 46 of the spine. A coupler link 54 is also generally vertically oriented and is carried on and connected to a part of the seat holder 34. In this example, the frame link 52 and coupler link 54 provide fixed connection points between the seat holder 34 and the spine 28 and the coupler link is effectively driven by the linkage assembly.

The linkage assembly in this example also includes a pair of generally parallel traversing links with an upper follower link 56 positioned vertically above and spaced from a lower crank link 58. The upper follower link 56 has a proximal end pivotally joined to the frame link 52 at a first pivot joint 60. A proximal end of the lower crank link 58 is pivotally coupled at a second pivot joint 62 to the frame link 52 below the first joint 60 on the spine. The distal end of the upper follower link 56 is pivotally coupled at a third pivot joint 64 to the upper end of the coupler link 54 on the seat holder 34. Similarly, the distal end of the lower crank link 58 is pivotally coupled at a fourth pivot joint 66 to the lower end of the coupler link 54 on the seat holder.

FIG. 2B illustrates an enlarged partial section or cut-away view of the linkage assembly in the disclosed example. The frame link 52 on the spine 28 and the coupler link 54 on the seat holder are each in the form of a box structure. The upper follower link 56 incorporates a pair of laterally spaced apart link bars 68; each positioned on opposite sides of and pivotally connected to the exterior surfaces 70, 71 of the box-shaped links 52 and 54, respectively. The lower crank link 58 employs a similar construction with a pair of laterally spaced apart link bars 72 pivotally joined to the exterior surfaces 70, 71 of the respective boxes of the links 52 and 54. In this example, each pair of bars 68 and 72 is connected by a pivot pin 76 at each of the four joints 60, 62, 64, and 66. The frame link 52 is the fixed ground link and the coupler link 54 acts as the link whose motion is being controlled in the four-bar linkage assembly. The crank link 58 drives the coupler link 54 vertically and thus creates vertical movement of the seat holder 34 to which the coupler link 54 is attached. A spring mechanism 80 is provided as a part of the linkage assembly in this example to impart and sustain a vertical oscillating motion in the device 20. The spring mechanism 80 traverses across the four-bar assembly and extends from the upper first pivot 60 on the frame link 52 to the lower fourth pivot 66 on the coupler link 54. The spring mechanism 80 is connected to the distal ends of the lower link 58 and, thus, the lower link is deemed the "crank" or driving link of the assembly.

The spring mechanism 80 employs a pair of U-shaped couplers 82*a*, 82*b* freely pivotally coupled to the pins 76 of the respective first and fourth pivot joints 60 and 66. A coil spring 84 is connected to one of the couplers 82*a* at one end. The opposite end of the coil spring 84 is connected to a threaded rod 86 of an adjuster 88. In the disclosed example, the opposite ends of the spring 84 are received through openings in the corresponding coupler 82*a* and adjuster rod 86. A threaded collar 90 is coupled to the threaded free end of the rod 86. A second threaded rod 92 extends from an end of the coupler 82*b* at the fourth pivot 66. The collar 90 is also attached to the threaded rod 92.

By rotating the collar 90, one can adjust the length of the spring mechanism 80 and, thus, the tension of the spring 84. Shortening the length of the spring mechanism 80 increases the tension on the coil spring 84 and lengthening the spring mechanism reduces the tension on the spring. The spring mechanism 80 extends as shown in FIG. 2B from corner to corner of the four-bar linkage assembly. With this arrangement, the tension of the spring draws the fourth pivot 66, and thus the crank link 58 upward and toward the first pivot 60 to raise the seat holder 34. When an occupant is seated in the seat 36, either their own movement or an external force applied by a caregiver downward to the support arm assembly 30 will cause the linkage assembly and, particular, the coupler link 54 on the seat holder 34, to move downward. This movement causes the spring assembly 80 to stretch or lengthen, increasing the tension on the spring 84. The resiliency of the spring will then draw the fourth pivot 66 and the crank link 58 upward and again toward the first pivot 60 on the frame link 52. The spring 84 will then impart a resilient bouncing motion. With this arrangement, the balance of the spring tension and the weight of the occupant will cause the support arm assembly 30 and, thus, the seat 36 to vertically oscillate as depicted in the dashed lines of FIG. 1 and by the arrows V.

FIGS. 1 and 2B illustrate one of many possible examples of a mechanism that can impart vertical oscillatory motion in the device 20. Other configurations and constructions are certainly possible and are within the scope and spirit of the present invention. Generally, the device 20 employs a cantilevered seat 36 and a device that can impart vertical oscillatory motion to the seat to create a bouncing motion for the seat occupant.

As will be evident to those having ordinary skill in the art, a cover can be provided to hide or mask the construction of the linkage assembly in this example and yet permit the full range of motion as desired for the device. The collar 90 can be turned in this example to lengthen or shorten the spring mechanism 80. A tighter spring 84 can accommodate a heavier child and/or reduce the range or motion and/or increase the oscillation frequency. A looser spring can accommodate a lighter child and/or increase the range or motion and/or decrease the oscillation frequency.

As shown in FIG. 3, the child motion device 20 can also incorporate on optional orbital motion about the spine 28. As shown, the support arm assembly 30 can optionally be configured and arranged so that it can rotate about or orbit the spine 28 axis. In one example, the support arm assembly 30 can rotate between two extremes E through an angle β of about 120 degrees. This angle can vary and can be greater than 360 degrees or can be less than 120 degrees, and yet can fall within the spirit and scope of the invention. The support arm assembly 30 can be substantially horizontal and the rotation axis defined by the spine can be substantially vertical herein. Alternatively, either the spine or the support arm assembly, or both, can be angularly offset from these horizontal or vertical references.

A motor or drive system 100 (shown in phantom only) can be provided within the housing or cover 46. The motor 100 can oscillate a pivoting section 102 of the spine 28 about the vertical axis of the spine. The support arm assembly 30 in this example can extend from the section 102 of the cover 46. As depicted in FIG. 3, the support arm assembly 30 can travel through an arc through the angle β in an oscillating back and forth motion represented by the arrows O.

Alternative arrangements for the optional orbiting motion of the device 20, and particularly the support arm assembly 30, can be used to produce slightly different motions. The support arm 30 can rotate about an axis of rotation defined by the orientation of the spine 28. The axis of rotation can be aligned with a vertical axis relative to the reference plane or floor surface 26. The support arm assembly 30 can also be set to rest perpendicular to the axis of rotation. However, either one or both the support arm assembly 30 and/or its axis of rotation can alternatively be tilted at an angle offset relative to the reference plane of the floor surface or the generally vertical reference axis. The support arm and/or the axis of rotation can even be tilted away from the travel arc if desired. The orbit motion of the support arm assembly 30 can thus be configured to sweep the seat 36 through the arc or travel path O in a plane that either stays parallel to the horizontal reference or floor surface or tilts relative to the horizontal reference. The actual motion of the seat holder 34 imparted by the orbit motion could thus have both a rotational component about the rotation axis as well as a slight vertical component. The bounce feature imparted according to the present invention can further vary the motion characteristics for the seat 36.

In any of these examples, the support arm assembly 30 can be formed either as a linear component or having one or more bends or curves. The shape and contour of the support arm assembly 30 can also be used to further enhance the travel characteristics of the seat 36. The arm and the bounce imparting structure, such as the linkage assembly in this example, can be configured to retain the seat 36 oriented substantially level with the floor surface or horizontal reference. Alternatively, the structure can be configured to alter the seat angle during its motion.

As will be evident to those having ordinary skill in the art upon reading this disclosure, the vertical motion characteristics of the device 20 in FIG. 1 can be created naturally either by movement of an occupant of the seat 36 or externally by someone raising or lowering and then releasing the support arm assembly 30. The optional orbit or rotational motion shown in FIG. 3 can also be imparted naturally using a torsion spring or some other mechanical arrangement within the spine 28. In alternative examples, the disclosed motion devices can be configured to oscillate automatically. The vertical bounce motion and/or the optional orbit motion can be motorized or rendered automatic.

Figure 4:
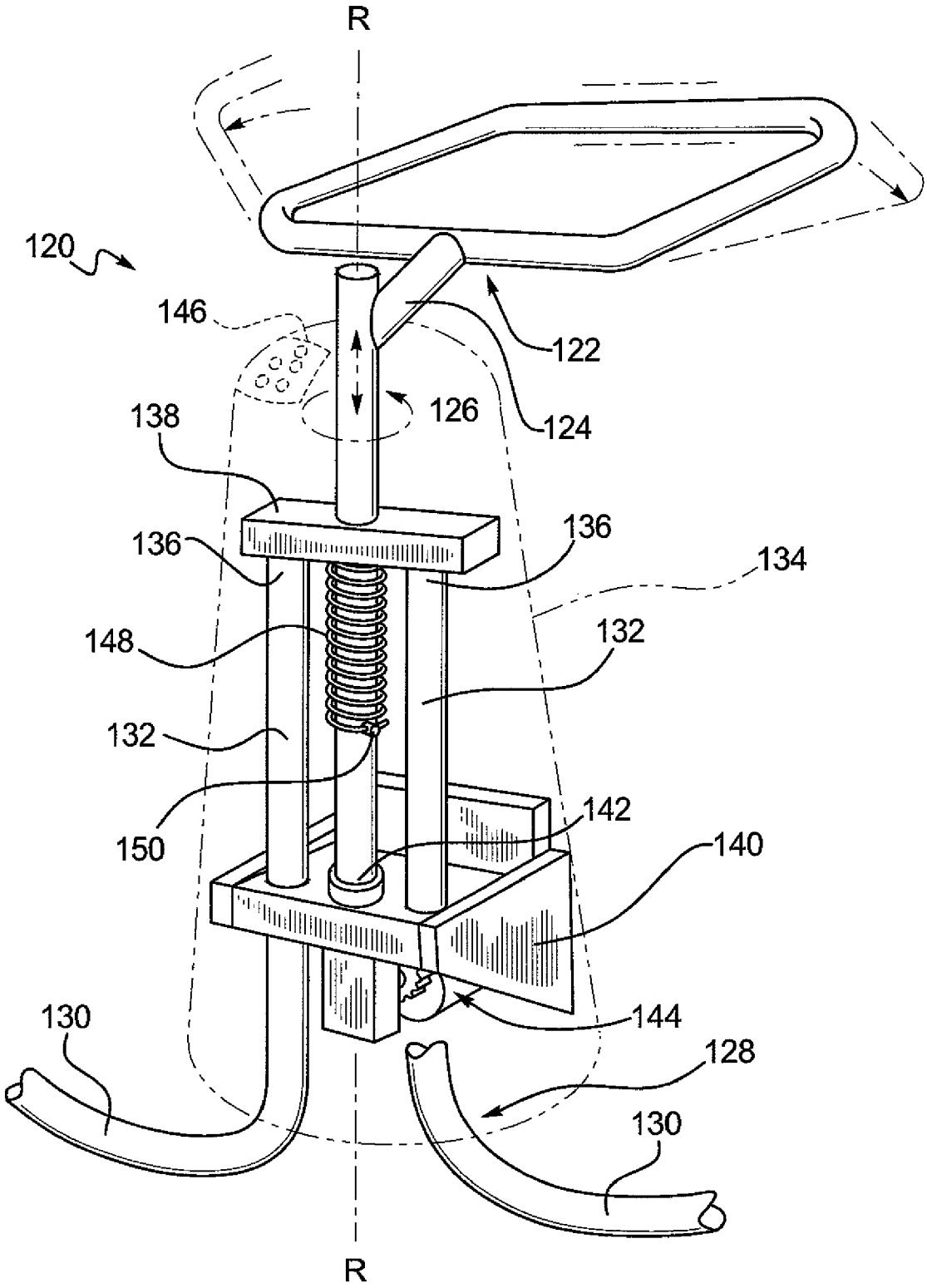
FIG. 4 is a cut-away view of a spine showing one example of the inner workings of a child motion device constructed in accordance with the teachings of the present invention.

FIG. 4 shows one alternate example of a child motion device 120 that has both vertical bounce and oscillating orbiting motion. FIG. 4 is also representative of one of many possible examples of the inner workings of the spine 28 and housing 46 for a child motion device constructed in accordance with the teachings of the present invention. In this example, a support arm 122 has a driven end 124 coupled to a pivot rod 126. The rod 126 is supported for rotation in a generally vertical orientation about an axis of rotation R. In this example, the frame assembly has a base section 128 with a pair of legs 130 that each terminate in an upward extension 132 within a housing 134 of the device's spine. These frame parts or legs 130 are linear extensions of the base section 128 and are spaced laterally from one another. Their distal ends 136 are connected to and rotationally retained within an upper bearing block 138. Lower regions of these frame parts or legs 130 are rotationally retained in position within a lower bearing block or motor mount 140. In this example, the legs 130 of the base section 128 can be rotated forward or rearward about an axis of the legs within openings of the bearing blocks between in-use and folded configurations. This structure is representative of another alternative foldable base section structure.

Each bearing block 138 and 140 has a central bearing opening for receiving and rotationally supporting the support arm rod 126. In this example, a lower end 142 of the rod 126 can terminate below the lower bearing block 140 and be coupled to a motor or other drive mechanism 144. The drive mechanism 144 can be configured to reciprocally rotate the rod 126, and thus the support arm 122, through a predetermined travel angle, such as 120 degrees as mentioned above. The motor or drive mechanism 144 can include features that can be manipulated by a user to adjust the angular travel, the speed of rotation, and the like. An operator panel, touch pad device, remote control unit, or user interface can be provided on or with a portion of the housing 134 with buttons, a touch screen, a keypad, switches, combinations of these features, or the like that a user can manipulate to access, operate, adjust, and alter various performance characteristics of the device. FIG. 4 shows one example in phantom of a touch pad or screen 146 carried on a part of the housing 134. The position of the control panel can in one example be adjusted or portable, either by moving part of the housing or by providing a remote control unit, to a position or height more suitable for access by an adult.

In one example, a user interface with a "cap-touch" or capacitive feedback circuit can be employed. The interface senses a change in capacitance near an electronic part of the device, which can be programmed to trigger a signal to an integrated circuit. The capacitance change signal can be designed to trigger based on human contact or contact with a metal object that closely approaches the interface or an electronic board. Many advantages could be achieved by this type of user interface. First, the threshold change level can be designed to be child-proof, i.e., to prohibit a child from altering the product settings or operational mode. Also, the same electronics can be utilized within a motion feedback loop. A metal projection or finger can be coupled to any moving part of the seat and can be positioned to move relative to the electronic board as the support arm moves. The electronics can then track or monitor the arm motion through the relative capacitance changes. This feature could be used for product cycle and motion parameter purposes to control the device.

Additional play or entertainment features can also be employed in the disclosed devices. Motion speed options, music and sound options, and other entertainment features can be configured as part of the device. These features can be electronically linked to occur as part of optional, selectable program settings or use modes. For example, a "soothing" setting could be programmed to pre-select music or background sound to accompany a particular use mode or other product features to create desired characteristics for that setting. Other optional settings can have their own pre-programmed or selectable features as well. Additionally, different play features associated with the devices can be employed in different ways, depending upon the selected child seat orientation. For example, with the seat facing the axis of rotation R of the support arm, the child's field of view will essentially always be the spine and its housing. An entertainment device, a toy, a video screen such as an LCD screen, or the like can be mounted on or part of the housing to entertain the child as they move. Toys or other play features can also be provided as part of or attachable to the child seat 36, if desired.

Though not shown in detail herein, the components of the drive mechanism 144 can vary considerably and yet fall within the spirit and scope of the present invention. In one example tested and proven to function properly, the drive mechanism can be in the form of an electromechanical system coupled to the rod 126 to generate the desired motion. In one example, an electric DC or AC motor can be coupled to a worm gear, which can then be coupled to a worm gear follower. The follower can drive a crank shaft. The energy of the drive shaft can be transformed from pure rotary motion to an oscillating or reciprocating motion through a notched bracket, which in turn is coupled to a spring. The spring can be coupled to the rod 126 to oscillate the support arm through its motion.

The spring (not shown) can act as a rotary dampening mechanism as well as an energy reservoir. The spring can be implemented to function as a clutch-like element to protect the motor by allowing out-of-sync motion between the motor and rod 126. Thus, the rod 126 need not be directly connected to the motor. There are certainly many other possible drive mechanisms or systems that can also be employed to impart the desired oscillatory or reciprocating motion to the support arm of the devices disclosed herein. These can include spring-operated wind-up mechanisms, magnetic systems, electromagnetic systems, or other devices to convert drive mechanism energy and motion to the reciprocating or oscillating motion of the disclosed devices. In each case, the construction of the devices disclosed herein allow the drive system parts to be housed in a housing and positioned below the child seat level. The mechanisms are thus out of the way, resulting in reduced noise levels to an occupant, a highly compact product configuration, and virtually unimpeded access to the child seat.

One example of a structure that can induce a bouncer feature to the device is also depicted in FIG. 4. In this example, a spring 148 is captured between and coupled to the upper bearing block 368 and spring stops 150 positioned on the rod 126. The drive mechanism can be configured to impart a vertical movement or oscillation to the lower end 142 of the rod 126 along its axis. The spring 148 can dampen but assist in retaining oscillatory bouncer movement to the support arm. Alternatively, the rod 126 and spring 148 can simply be mechanically constructed to permit movement of the seat in the support arm 122 to create occasional bouncing motion. A child's motion or a parent's touch can impart such mechanical bouncing motion.

Instead of, or in conjunction with, the linkage assembly of FIGS. 1-3 or the motor 144 and spring 148 arrangement shown in FIG. 4, various mechanisms, cam surfaces, linkages, dampers, springs, or other mechanical arrangements can be employed within the disclosed devices 20 or 120 to impart the vertical "bounce" movement of the support arm assembly 30 shown in FIG. 1. The invention is not intended to be limited to only the disclosed embodiment herein.

Figure 5:
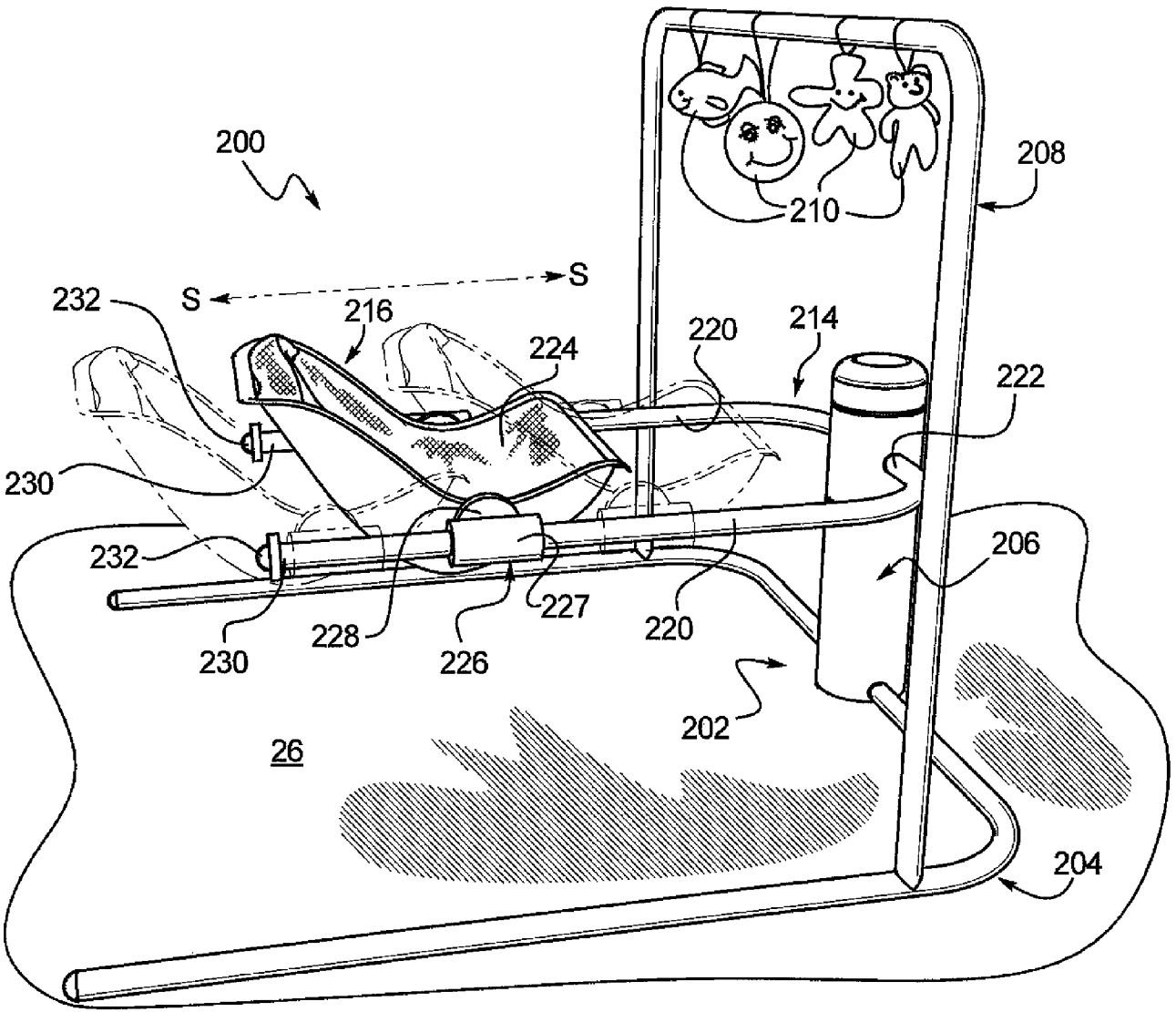
FIG. 5 is a perspective view of another example of a child motion device constructed in accordance with the teachings of the present invention.
Figure 6:
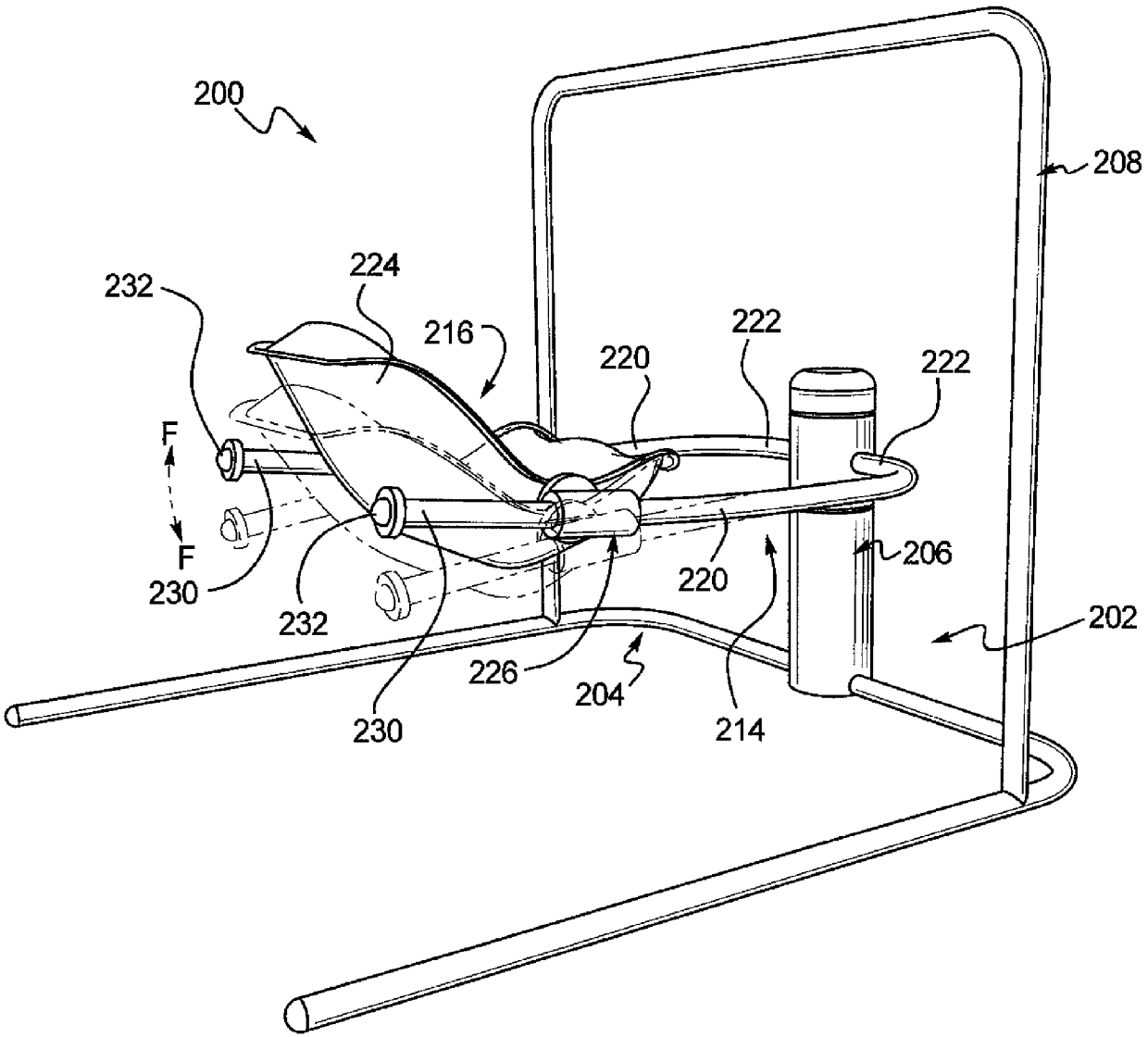
FIG. 6 is a perspective view of the child motion device shown in FIG. 5 and depicting a bounce motion imparted to the child.
Figure 7:
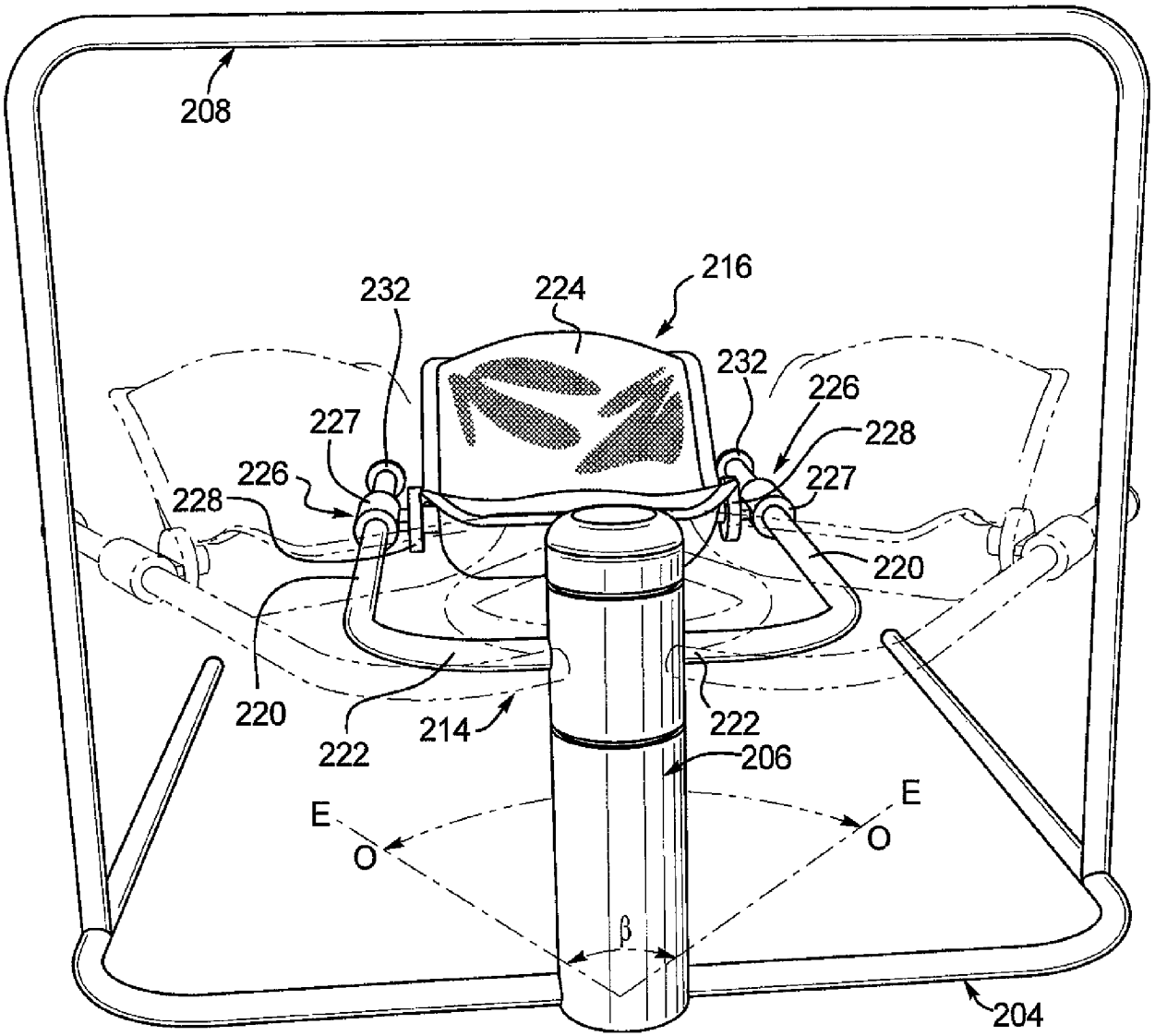
FIG. 7 is a rear elevation of the child motion device shown in FIG. 5 and depicting an optional orbital motion that can be imparted to the child.

FIGS. 5-7 illustrate another alternative example of a child motion device that can impart a vertical oscillating or bounce motion to seat occupant of the device. In this example, a device 200 has a frame assembly 202 with a U-shaped base 204 resting on a floor surface 26. One example of an optional entertainment or toy bar 208 is illustrated extending upward from the base 204 in this example. A plurality of toys 210 are suspended from the bar 208 and are visible to a seat occupant in this device 200. As will be evident to those having ordinary skill in the art, the structure and configuration of the frame assembly 202, including the base and the toy bar can vary considerably and yet fall within the spirit and scope of the present invention. Such an entertainment or toy bar can be employed on any of the disclosed child motion devices herein.

In this example, the device 200 also includes a spine 212 extending upward from a part of the base. A support arm assembly 214 is coupled to and cantilevered from the spine 212. A seat assembly 216 is supported on the support arm assembly 214. The support arm assembly 214 in this example includes a pair of support arms 220 that are cantilevered from a torsion bar 222 coupled to the spine 212. Thus, the support arm assembly 214 in this example is also a U-shaped structure with the torsion bar 222 interconnecting the pair of arms 220. The torsion bar 222 in this example extends through the spine 212. In alternative examples, the arms 220 can simply be separate structures physically attached independently to the spine 206. In either example, the torsion bar 222 or other attachment structures should not rotate relative to the spine.

The seat assembly 216 in this example includes a seat 224 and a pair of collars 226 mounted to opposite sides of the seat. Each of the disclosed arms 220 is a flexible elongate tube or a flexible solid bar having a cylindrical circular construction. Each of the collars 226 has a hollow sleeve 227 slidably received over a respective one of the arms 220. The tilt orientation of the seat 224 can be adjustable by providing an adjustment mechanism with each of the collars 226 to permit pivoting the sleeve 227. In this example, each sleeve is mounted to a support plate 228 carried on the side of the seat 224. The sleeves 227 can be selectively rotationally adjustable about an axis perpendicular to the support plate 228.

As shown in FIG. 5, the longitudinal position of the seat 224 along the support arms 220 can be adjustable. A user can slide the seat 224 by the collars 226 along the arms 220 toward and away from the spine 206 to create different motion characteristics for the seat occupant. Various types of locking or latching mechanisms can also be employed on the collars 226, the support arms 220, or a combination thereof. Thus, the device 200 shown in FIG. 5 can be constructed so that the seat can be positionally adjusted by sliding the seat assembly 216 in the direction of the arrows S along the support arms 220 to a desired position. The seat can then be locked in place at the chosen location on the arms.

In one example, the support arms 220 and the sleeves 227 on the collars 226 can be configured with a resilient pin and hole arrangement. The support arms 220, for example, can be provided with a plurality of openings along the length of the arms. One or more resilient pins can be provided within the sleeve on the collars. The pins can pop into selected holes on the arms 220 and lock the seat assembly 216 at a selected location along the arms. In another example, the seat 216 can be removed from the arms 220 by sliding the collars off the free or distal ends 230 of the arms. The seat assembly 216 can then be turned around and slid back on the arms with the seat facing in the opposite direction. As shown in FIGS. 5-7, the device 200 can be provided with a removable cap or stop 232 on the distal end 230 of each of the arms 220 to retain the seat on the arms and to permit removal and replacement or reorientation of the seat.

Vertical oscillating or bounce motion is imparted in the device 200 in a manner different from the previously disclosed examples. As shown in FIG. 6, each of the support arms is bendable along its longitudinal axis via the resilient flexible nature of the arms. The arms 220 can be constructed from any suitable material and preferably from a material that will not fatigue over time through continued oscillating movement. For example, a high strength, resilient, durable material can be selected. The material can be such that it oscillates once subjected to motion and loads. The degree of vertical motion depicted by the arrows F will depend on the flexible nature of the arms, the weight of the seat occupant, the weight of the seat assembly 214, and the longitudinal position of the seat assembly along the arms 220.

As with the previous examples, the vertical motion F of the seat assembly 214 can be imparted naturally either by movement of the occupant of the seat 224 or externally by a caregiver raising or lowering the seat and then releasing the seat to begin oscillating motion. Alternatively, the spine 206 can be constructed with a drive mechanism (not shown) that is coupled to the support arm assembly 214 in a manner that can generate automatic and continued oscillating motion as depicted in FIG. 6. The drive mechanism could vibrate or raise and lower the support arm assembly 214, or cause slight rotation in the torsion bar 222 to impart bounce in the arms 220.

In another optional example, a rotational or orbiting motion can also be provided in combination with the vertical bouncing motion provided by the support arm assembly 214. FIG. 7 illustrates orbiting movement in the direction of the arrows O. Again, the orbital movement can also be provided through natural oscillation generated by movement of the seat occupant or externally by a person pushing or pulling the structure to one side and then release. Alternatively, an automatic oscillating motion can be generated by use of a suitable drive mechanism (not shown) housed in the spine 206.

The device 200 can be configured to impart bounce motion or combined bounce and orbit motion in a number of alternate ways. For example, a telescoping tube arrangement can be employed in the spine 206 supporting the arm assembly 214. The two tubes can be resiliently, vertically slidable relative to one another to either impart most or all of the bounce motion (using stiff arms 220) or to enhance the bounce motion of the flexible arms disclosed herein. A spring device could be employed in such an arrangement. In another example, these same telescoping tubes can be arranged to resiliently rotate relative to one another to impart the optional orbit motion to the device. In yet another example, a vertical shaft can be employed in the spine 206 to support the arms assembly 214. This vertical shaft can be fabricated in a manner and/or from a material that renders it flexible and resilient under torsion stress (twisting) to impart the optional orbit motion. These and other examples of devices and structures can be employed to impart the desired motion characteristics and yet fall within the spirit and scope of the present invention.

Figure 8:
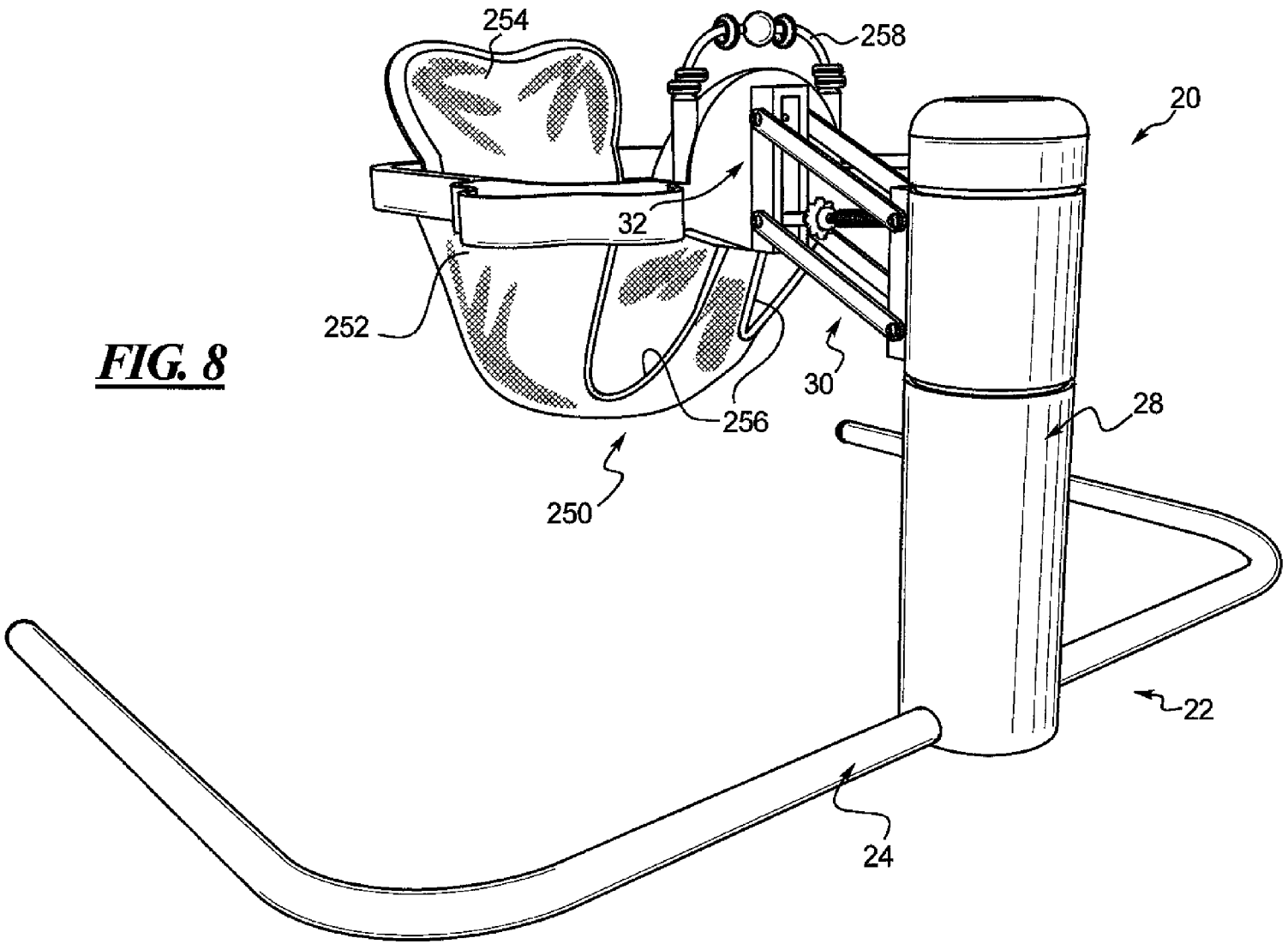
FIG. 8 is a perspective view of the child motion device of FIG. 1 modified for a different purpose and a different sized child.
Figure 9:
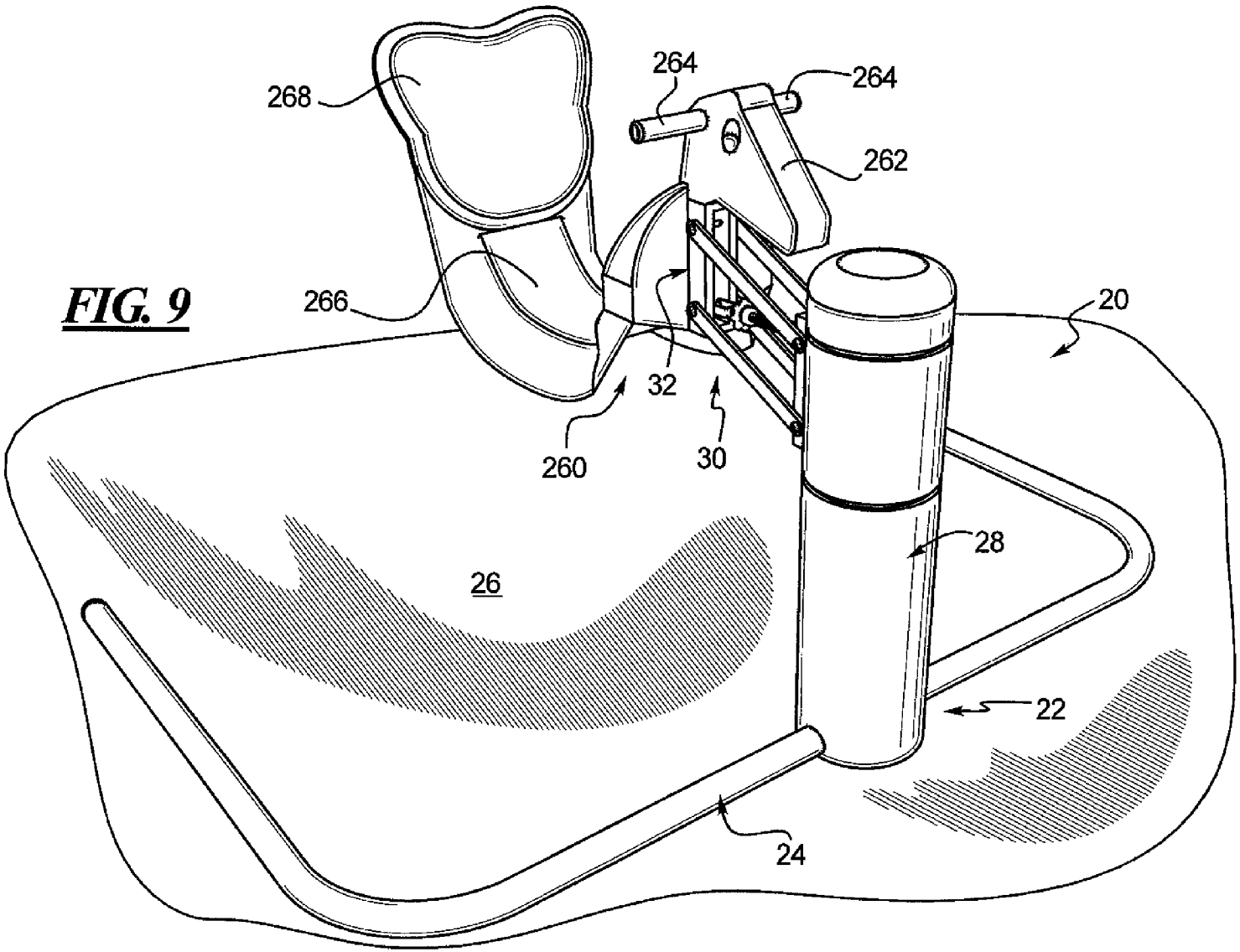
FIG. 9 is a perspective view of the child motion device shown in FIG. 1 modified yet again for a different purpose and a different sized child.

In another aspect of the present invention, each of the disclosed devices 100, 120, and 200, as well as other alternative child motion devices that falls within the spirit and scope of the present invention, can be configured to adapt as a child grows. Each of the devices in FIGS. 1-7 can be configured to accept an infant carrier or infant car seat rendering the motion device suitable for very young infants and small children. FIGS. 8 and 9 depict only two of many possible examples of alternative, replaceable, interchangeable child supporting devices that can be configured to mount to one of the child motion devices disclosed herein.

FIG. 8 illustrates a sling type seat assembly 250 mounted to the seat holder 34 of the child motion device 20 that was previously described and shown in FIG. 1. In this example, the child seat 36 has been removed and replaced by the sling seat assembly 250. The sling seat assembly 250 in this example includes a fabric sling seat 252 suspended from a frame structure (not shown) that removably mounts to the seat holder. The sling seat assembly 250 has a low height seat back 254 that can provide some support for an occupant of the seat 252. The sling seat 252 also includes a pair of leg openings 256 as is known for a conventional sling seat. In this example, a child can be placed in the sling seat 252 with their legs protruding through the leg openings 256. The child's feet can be such that they may be able to touch the ground. The child jump up and down using their legs and feet to create a vertical oscillating motion in the device. Such a device could be highly entertaining for the seat occupant as well as provide exercise and enjoyment. A toy bar option 258 is also illustrated in this example. The toy bar option 258 can be provided as a part of the device 20 and mountable only to the seat holder 34 or optionally can be provided as a part of the replacement sling seat assembly 250. Clearly, other toy bars and other entertainment options can also be mountable to a part of the child motion device in this and the other disclosed examples herein.

FIG. 9 illustrates another example of a removable, replaceable, interchangeable child supporting or seating option that can be employed in conjunction with any of the disclosed child motion devices in order to render the device usable for a larger child. In this example, the motion device 20 has been modified by replacing the seat with a hobby horse 260. The hobby horse includes an ornamental horse head 262 with a pair of handlebars 264 or grips that project laterally outward from the sides of the head. The hobby horse 260 also has a seating area or saddle 266 and a back support 268 positioned spaced rearward from the head 262 on the other end of the saddle. In this example the hobby horse is shown as a complete replacement for the seat holder 34 and the seat 36. Accordingly, the device 20 can be configured so that the seat holder 34 is removable from the device. In this example, the linkage assembly of FIGS. 1-3, including the coupler link 54, remains a part of the spine 28 and only the seat holder 34 and seat 36 have been removed and replaced with the hobby horse 260. However, the hobby horse and other child supporting devices can be configured to be placed in or coupled to the seat holders 34, similar to the seat 36 and the sling seat assembly 250.

As will evident to those having ordinary skill in the art, the hobby horse is disclosed merely as one of many possible examples of child supporting devices that can be mounted to a child motion device to accommodate children as they grow. As a child grows, the spring assembly 80 of the linkage assembly in this example can be adjusted to accommodate the heavier child and the different supporting devices such as the hobby horse 260 and the sling seat assembly 250. The child motion device 120 can be provided with an adjustment feature relative to the spring 148 as well as the motor 144 to accommodate larger size, heavier children. The child motion device 200 can accommodate different sized children by positionally adjusting the child supporting devices along the support arms 220 to alter and accommodate for vertical motion characteristics.

Figure 10:
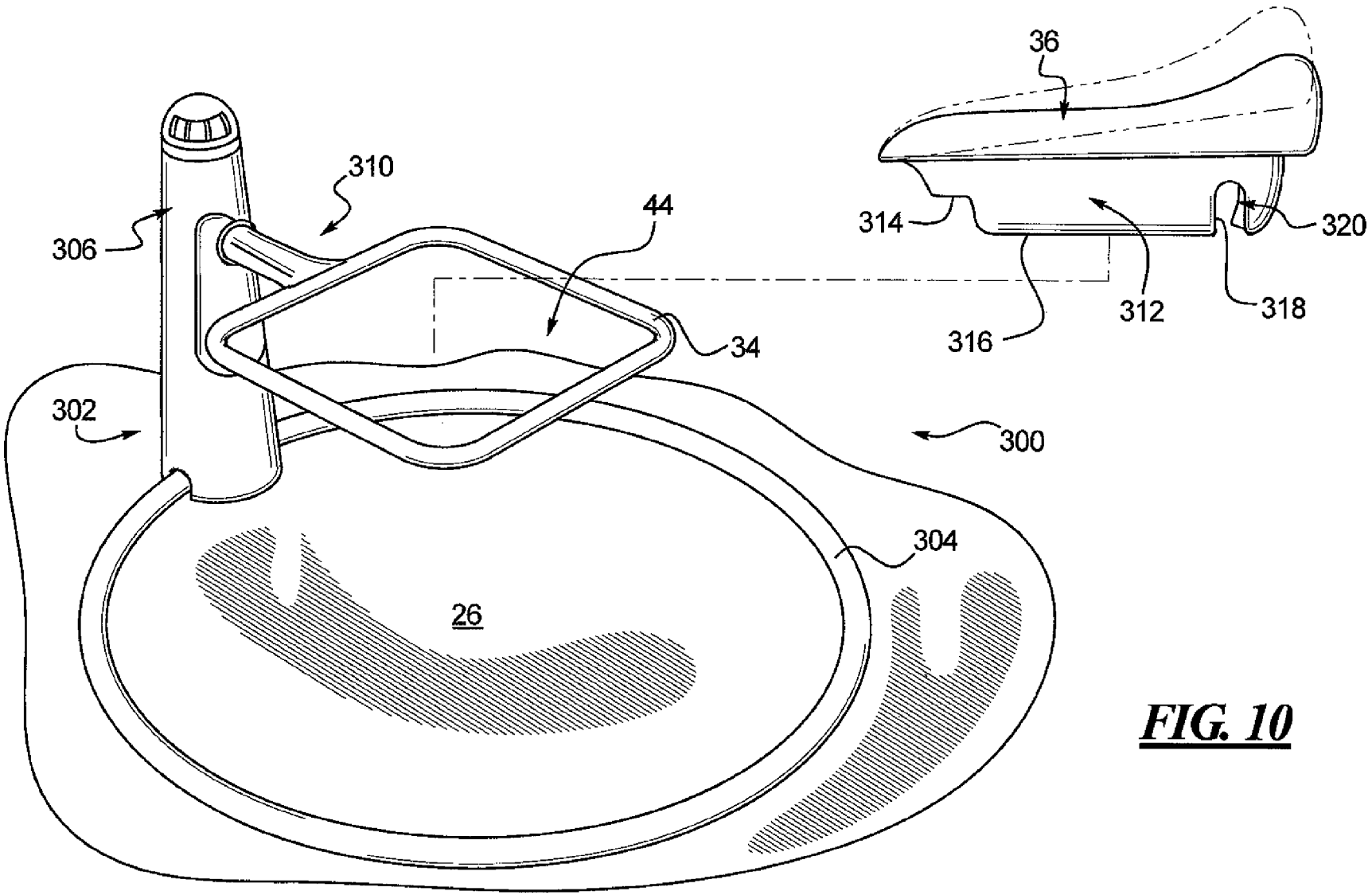
FIG. 10 is a perspective exploded view of a child motion device constructed in accordance with the teachings of the present invention and depicting that the child seat can be remove, reoriented, and/or replaced relative to the device.

As noted above, the configuration of the child motion devices disclosed herein can vary considerably and yet fall within the spirit and scope of the present invention. FIG. 10 is provided to illustrate two optional aspects of the present invention. A child motion device 300 is shown in FIG. 10 as having a frame assembly 302 with a circular or hoop-shaped base 304 that has a spine 306 projecting upward from the base. The frame assembly of the previously described examples can readily and easily be replaced with a different frame configuration including the frame assembly 302 as shown in FIG. 10.

In another aspect, FIG. 10 has been provided to illustrate that the seat holder 34 may be configured to readily accept a child seat 36 or other child supporting device in any one or four different orientations. Thus, the sling seat assembly 250 disclosed previously, as well as the hobby horse 260, could also be provided as attachable to the seat holder 34 in any one or four different orientations either facing toward or away from the spine or facing left or right of the spine.

The child motion devices disclosed herein can provided a variety of different motions and views for an occupant of the child supporting device in each example. In one example of the invention, the seat holder 34 is configured to permit the child seat 36 to be selectively mounted on the support arm 30 in a number of optional orientations. In this example, the child seat 36 can have a contoured bottom or base 312 with features configured to engage with portions of the seat holder 34. When the seat 36 is rested on the seat holder, the child seat 36 can be securely held in place. In this example and in the example of FIG. 1, the seat holder is formed of generally linear side segments. The seat bottom has a flat region 314 on one end that rests on one linear side segment of the holder 34. A depending region 316 of the seat base 312 is sized to fit within the opening 44 of the holder. The other end of the base 312 has one or more laterally aligned notches 318 that are configured to receive the opposite linear side segment of the holder. The depending region 316 and the notches 318 hold the child seat 36 in place on the holder. Gravity alone can be relied upon to retain the seat in position. In another example, one or more positive manual or automatic latches 320 can be employed in part of the seat, at one or both ends of the seat, as part of the seat holder 34, and/or at one, two or all four sides of the seat holder to securely hold the child seat 36 in place on the seat holder 34. The latches 320 can be spring biased to automatically engage when the seat is placed on the holder.

Geometry and symmetry can be designed into the holder and seat or other child supporting devices (such as the seat 250, horse 260) to permit the seat to be placed in the holder in multiple optional seat orientations. As represented by dashed lines in FIG. 10, the seat and/or the seat holder (as described above with respect to the device 200) can also be configured to permit the incline of the seat or holder to be adjusted to various recline angles. In another example, the holder and/or the seat can be cooperatively designed to permit the seat or other child supporting device to be rotated between fewer than four, more than four, or even an infinite number of seat facing orientations when placed on the holder. Cooperating rotary discs i.e., a "Lazy Suzan" arrangement, could be employed on the two parts to achieve infinite orientation adjustment.

The child motion devices described herein can be constructed to simulate or mimic various movements that might be employed by a mother or father as they hold a child in their arms. An adult holding a child will often alternate raising and lowering their shoulders or pivoting their torso from side-to-side to simulate a rocking movement. Other times, an adult may bold the child in their arms and twist their torso from side-to-side creating a motion for the child through a segment of an arc. Other times, the adult may simply sway the child back and forth by laterally moving their elbows from side to side while holding the child. Sometimes an adult may employ a combination of such movements and/or may lean forward and tilt their spine at an angle toward the child when doing these motions. All of these motions are often performed along with a vertical bouncing motion imparted by the parent, either by using their legs, arms, or both.

In any instance, an adult can easily alter the position of the child held in their arms. Sometimes an adult may hold a child in a somewhat seated position with the child facing away from their chest. In another example, the child may be held in a position looking directly at the adult. In another example, the child may be held with their legs to one side and head to another side and rocked by the adult. The disclosed child motion devices can simulate any or all of these various proven, natural, calming and soothing movements. Parents usually hold their child and move them in a slow, even rhythm to help calm or soothe the child. The disclosed devices can be constructed to operate in a manner that also mimics the degree of movement and the natural frequency of oscillation that a child might experience when held in an adult's arms.

Figures 11A, 11B, 11C:
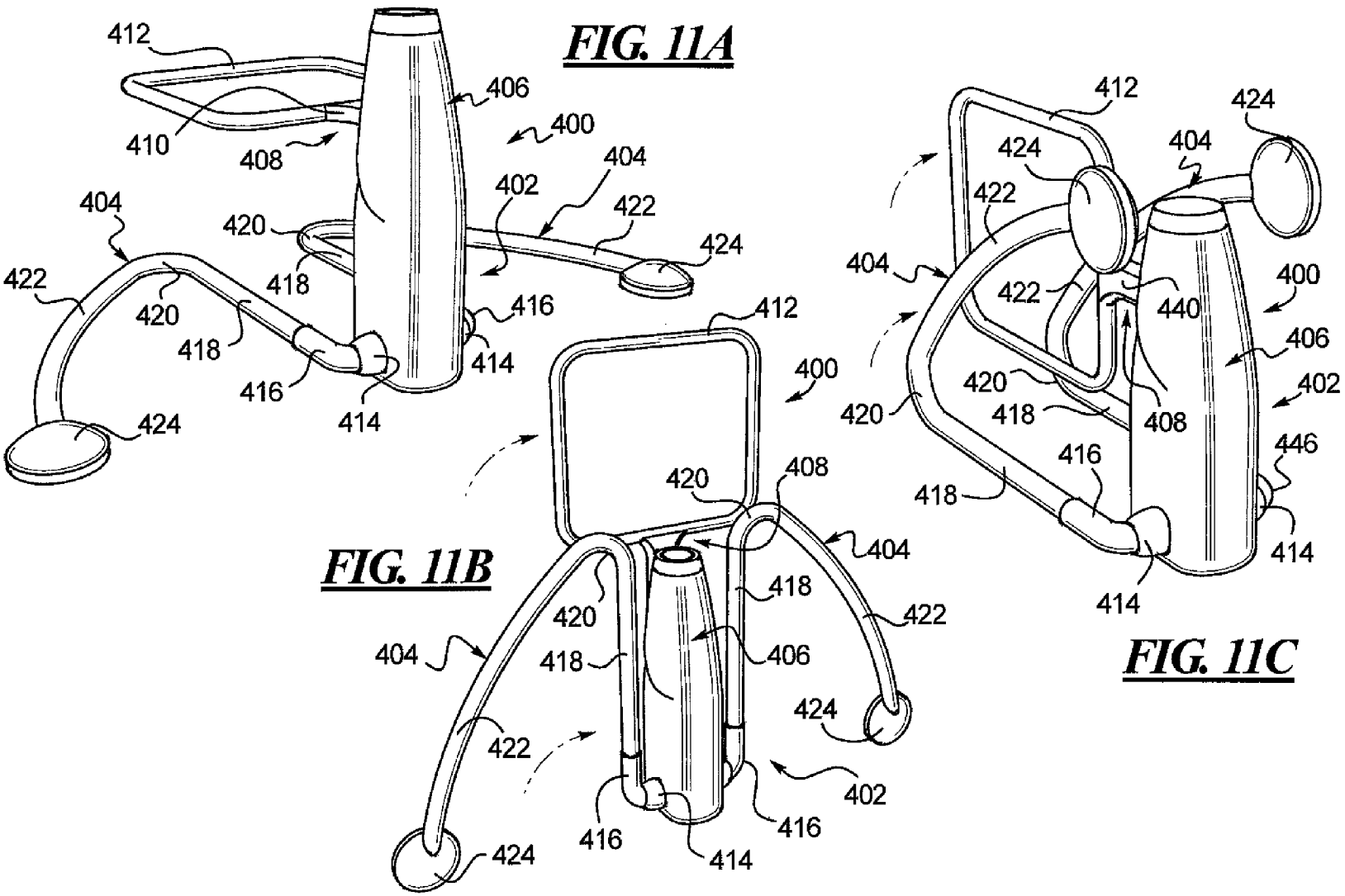
FIGS. 11A-11C show another alternative example of a foldable or collapsible frame structure that can be incorporated into the child motion devices disclosed herein.

As noted above, the disclosed devices can be configured to fold up or collapse for compact storage when not in use. The frame assemblies can be configured so as to pivot or fold parallel with the spine and to even fold upon itself to create a compact storage size and shape. FIGS. 11A-11C show one alternative example of a child motion device 400 constructed in accordance with the teachings of the present invention. In these figures, two alternative arrangements for a folded or collapsed configuration of the device 400 are also illustrated. In one example of the present invention, the child motion devices can be moved between a set-up condition such as that shown for the devices 20, 120, 200, and 300 and a folded or collapsed condition.

In this example, the child motion device 400 has a frame assembly 402 with a base section having two separate components 404. As with the previous example, the spine 406 extends generally vertically upward when in the set-up configuration shown in FIG. 11A. The device 400 in this example also has a support arm 408. In this example, a driven end 410 of the support arm 408 is movably coupled to the spine in a manner that permits the support arm to be collapsed or folded to a storage position from the in-use position shown in FIG. 11A where the support arm extends radially outward from the axis of the spine. A seat holder 412 is positioned at a distal end of the arm 408.

The base section components in this and other examples are described herein with reference to their position while in the in-use configuration and lying in floor reference plane. In this example, each of the base section components 404 has a first end 414 that is pivotally connected to a side of the spine 406. Each section 404 also has an elbow near the first end or connected end 414. The connected ends 414 project laterally outward from the spine 406 in this example and then the elbows 416 continue into an elongate linear segment 418 on each part or component 404. The elongate segments 418 project forward relative to the support arm position in the in-use configuration and then continue into an outward bend 420 from which a curved support leg 422 extends. The distal end of the support legs 422 each has a stabilizing foot 424. The feet are sized to increase the surface area of the base section support legs 422 that contact the floor surface when in the in-use configuration of FIG. 11A. In this configuration, the base sections 104 in this example extend forward beneath the support arm 408 and then laterally outward opposite from one another to create a stabile base section.

FIG. 11B illustrates one example of a folded configuration for the device 400 shown in FIG. 11A9. In this example, the base sections 404 pivot about a horizontal axis extending between the two connection ends 414. The base sections 404 can pivot upward so that the elongate linear parts 418 lie vertically adjacent the spine 406. In this same example, the support arm 408 is configured to pivot upward as well so that it lies in a plane essentially close to and parallel with a plane of the spine 406 and the folded up base sections 404. The very thin profile of this folded configuration permits the device 400 to be easily stored in relatively small, thin spaces.

FIG. 11C illustrates an alternative example of a folded configuration that can be employed in the device 400 shown in FIG. 11A. In this example, the linear parts 418 pivot about their respective ends that are connected to the elbows 416 and rotate inward toward one another. In this manner, the support legs 422 pivot upward toward one another and the linear parts 418 remain in a downward position against the floor surface. In this same example, the support arm 408 can be moved to a collapsed configuration in a different manner than that shown in FIG. 11B. In this example, the support arm 408 rotates longitudinally about its own forward extending axis to a position where its seat holder 412 lies in a vertical plane instead of the horizontal in-use position. Again, the folded configuration shown in FIG. 11C creates a compact device that can be easily stored in a storage space that has a low height and a relatively narrow width profile.

Figures 12A, 12B, 12C:
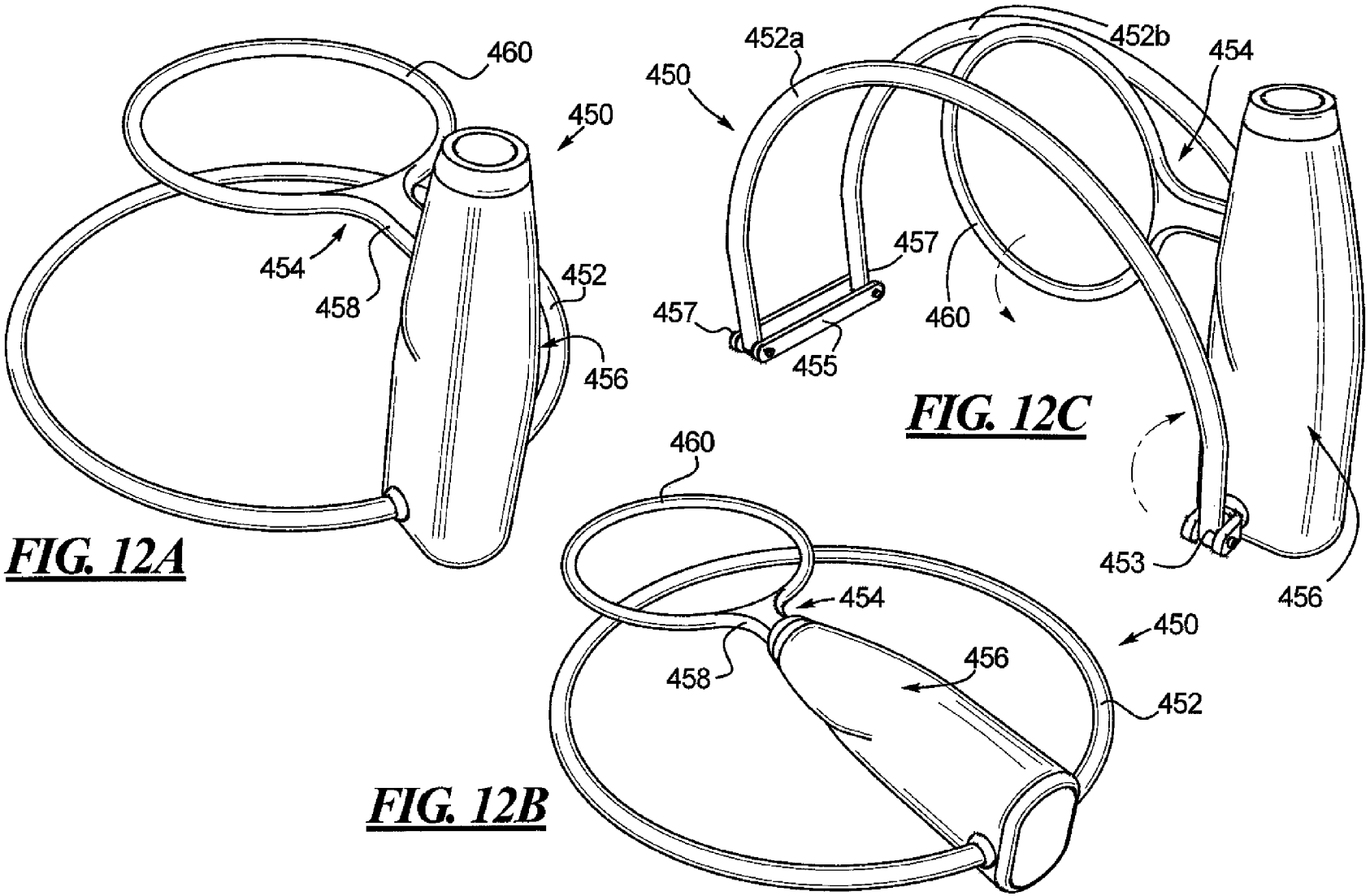
FIGS. 12A-12C show another example of a collapsible frame structure that can be incorporated into the child motion devices disclosed herein.

FIGS. 12A-12C illustrate another example of a child motion device 450 constructed in accordance with the teachings of the present invention. These figures again illustrate two alternative folded or collapsed configurations for the device 450 shown in FIG. 12A. In this example, the device 450 has a base section 452 configured as a hoop identical to that shown in the device 300 of FIG. 10. The device 450 also has a support arm 454 again extending radially outward from a spine 456 that projects upward from part of the base section. In this example, the support arm 454 has a driven end 458 coupled to the spine and a seat holder 460 at its distal end. The seat holder 460 in this example is configured as a circular ring surrounding an open space. A child seat (not shown) could have a bottom configured with vertical or angles slots to engage with opposite sides of the ring. With this seat holder configuration, the seat can then be oriented in virtually any rotational position on the seat holder as desired, and not just the four positions described previously for the device 20 and 300.

FIG. 12B illustrates an alternative example of a folded configuration that can be employed with the device 450 shown in FIG. 12A. In this example, the base section 452 can be pivotally connected along a generally horizontal axis to the base section 452 so that it can be folded forward into an opening within the hoop of the base section 452. In the same example, the support arm 454 can be pivotally coupled to the spine 456 so that it can be pivoted directly upward toward its rotation axis. When the spine 456 is folded downward toward the base section 452, the support arm 454 can be folded upward against or very close to the spine. When completely folded as shown in FIG. 12B, the components can lie generally in the same plane to form a very low height profile. In alternative examples not shown, the support arm 454 could also just as easily be collapsible in parts upon itself and/or could fold downward toward the spine 456.

FIG. 12C illustrates another alternative example of a folded configuration that could be employed with the device 450 shown in FIG. 12A. In this example, the base section has two halves 452*a*, each with opposed ends 453 being pivotally attached to opposite sides of the spine. A side of the base sections 452*a* opposite the spine can have a link 455 that pivotally connects free ends 457 of the base section halves. In this example, the two base section halves 452*a* can pivot upward toward one another and lie in generally parallel planes on opposite sides of the spine and project forward in the same direction from the spine. In this same example, the support arm can be rotationally coupled to the spine so that the seat holder 460 can be rotated about its own forward extending axis from a horizontal orientation to a vertical orientation lying in a plane between and parallel to the folded up base section halves.

Figures 13A, 13B:
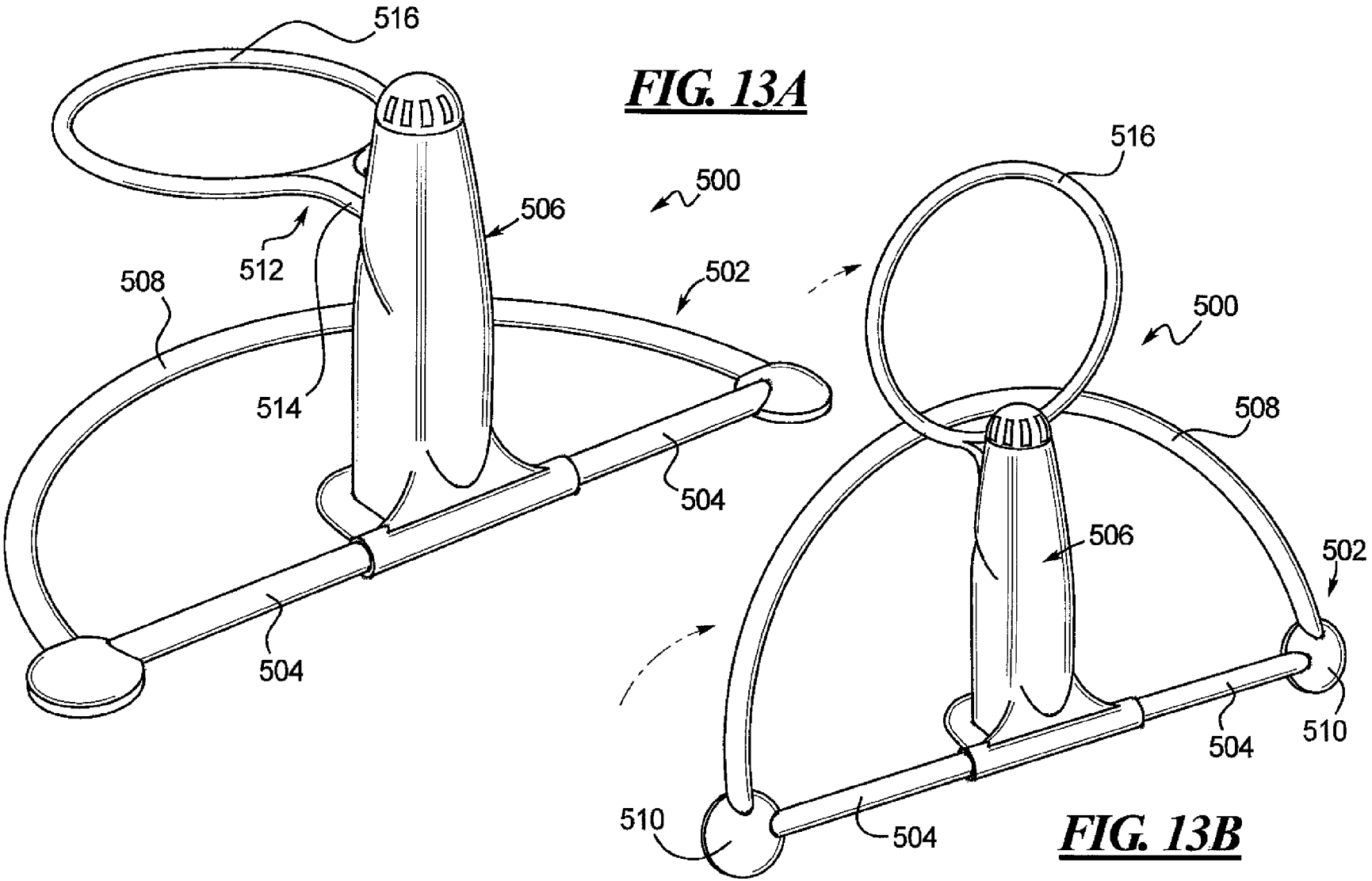
FIGS. 13A and 13B show another example of a frame structure that can be incorporated into the child motion devices disclosed herein.

FIGS. 13A and 13B illustrate yet another example of a child motion device 500 constructed in accordance with the teachings of the present invention. These figures illustrate only one alternative folded or collapsed configuration for the device 500, though other configurations are certainly possible. In this example, the device 500 has a base section 502 configured as a D-shaped structure. The base section 502 has a linear part 504 that extends through or beneath a spine 506. In this example, the spine 506 is positioned at about the mid-point of the linear part 504. The base section also includes a curved part 508 in the form of a one-half circle. The ends of the curved part 508 are coupled to the ends of the linear part 504 at knuckles or joints 510. In this example, the joints 510 are separate parts and are formed with large surface area, flat bottoms to assist in adding stability to the child motion device 500. In an alternative example, the D-shaped base section can be one continuous integral component. The device 500 also has a support arm 512 again extending radially outward from the spine 504 and that extends upward from the linear part of the base section 502. In this example, the support arm 512 has a driven end 514 coupled to the spine and a seat holder 516 at its distal end. The seat holder 516 in this example is also configured as a circular ring surrounding an open space, as described above in the examples of FIGS. 12A-12C.

FIG. 13B shows the device 500 in one example of a folded or collapsed configuration. In this example, the housing of the spine 506 and the linear part 504 of the base section 502 can pivot relative to one another to a generally co-planar position. As with a number of the previous examples, the support arm 512 in this example can also pivot upwards to lie in generally the same plane as the spine and base section. The device 500 also has a very flat, thin profile for easy storage when not in use.

Figures 14A, 14B:
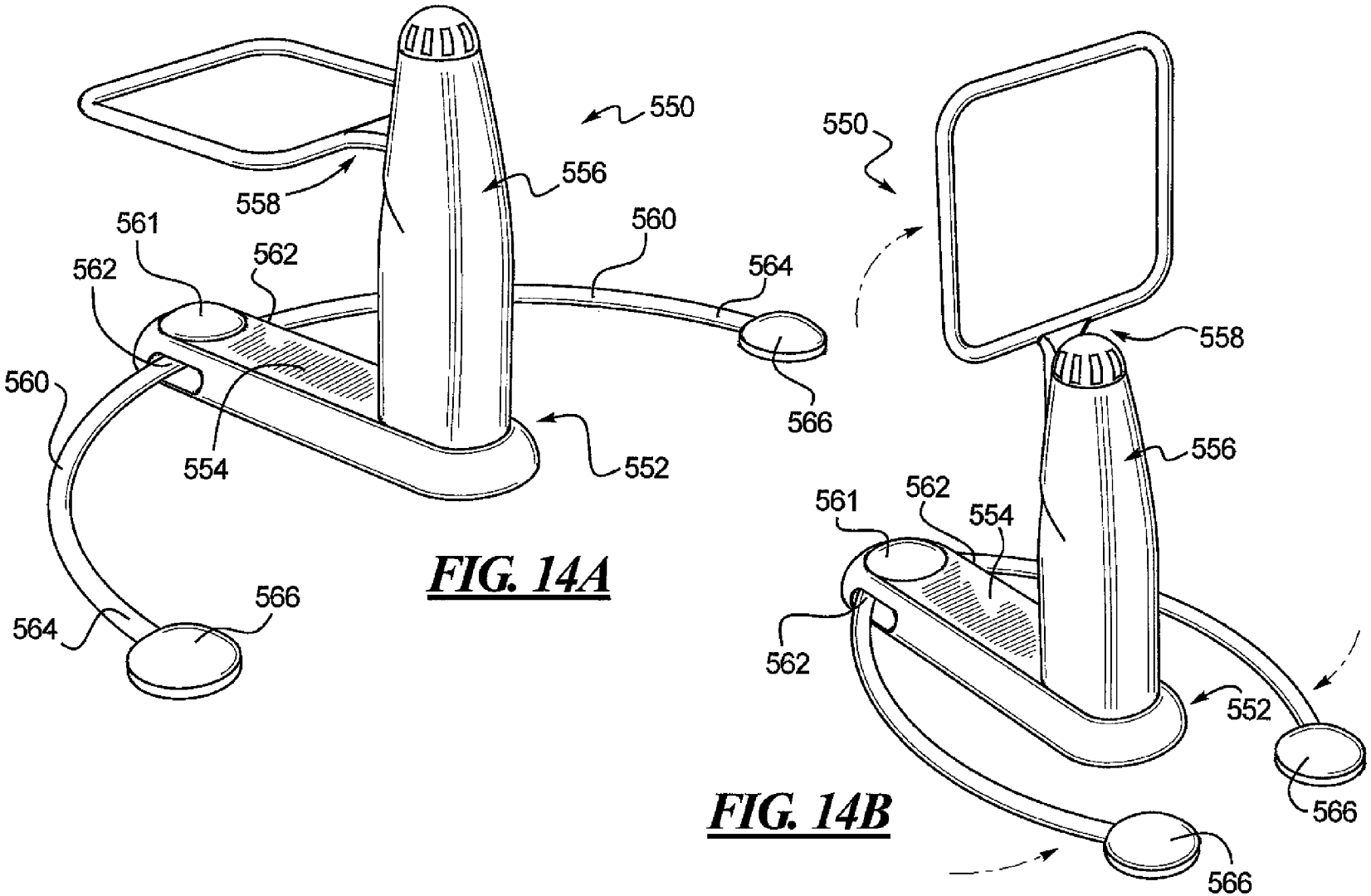
FIGS. 14A and 14B show another example of a collapsible frame structure that can be incorporated into the child motion devices disclosed herein.

FIGS. 14A and 14B illustrate still another example of a child motion device 550 constructed in accordance with the teachings of the present invention. These figures again illustrate only one alternative folded or collapsed configuration for the device 550, though other configurations are certainly possible. In this example, the device 550 again has a base section 552 to provide stable support for the device when in the set-up configuration as shown in FIG. 14A. The base section 552 in this example has a wide, flat leg 554 that extends in a forward direction relative to a spine 556 and a mid-travel position of a support arm 558. The support arm 558 is similar to that of the devices 20 and 300.

The base section 552 also has a pair of bowed parts 560 projecting opposite one another laterally outward from the distal end 561 of the leg 554. Each bowed part 560 has a pivoting end 562 connected to the distal end 561 of the leg 554 and has a free end 564 opposite the pivoting ends. The free ends 564 in this example also each include an end cap or foot 566 with a large, flat bottom surface to add stability for the device when in use. As shown in FIG. 18, the bowed parts 560 can pivot outward away from the leg to an in-use position providing a wide, stable base for the device. When folded, the bowed parts 560 can pivot inward toward the leg 554 to provide a narrower folded size. The support arm 558 in this example can pivot upward as shown, or can rotate from a horizontal plane to a vertical plane along a forward extending axis as described for previous examples.

Figure 15:
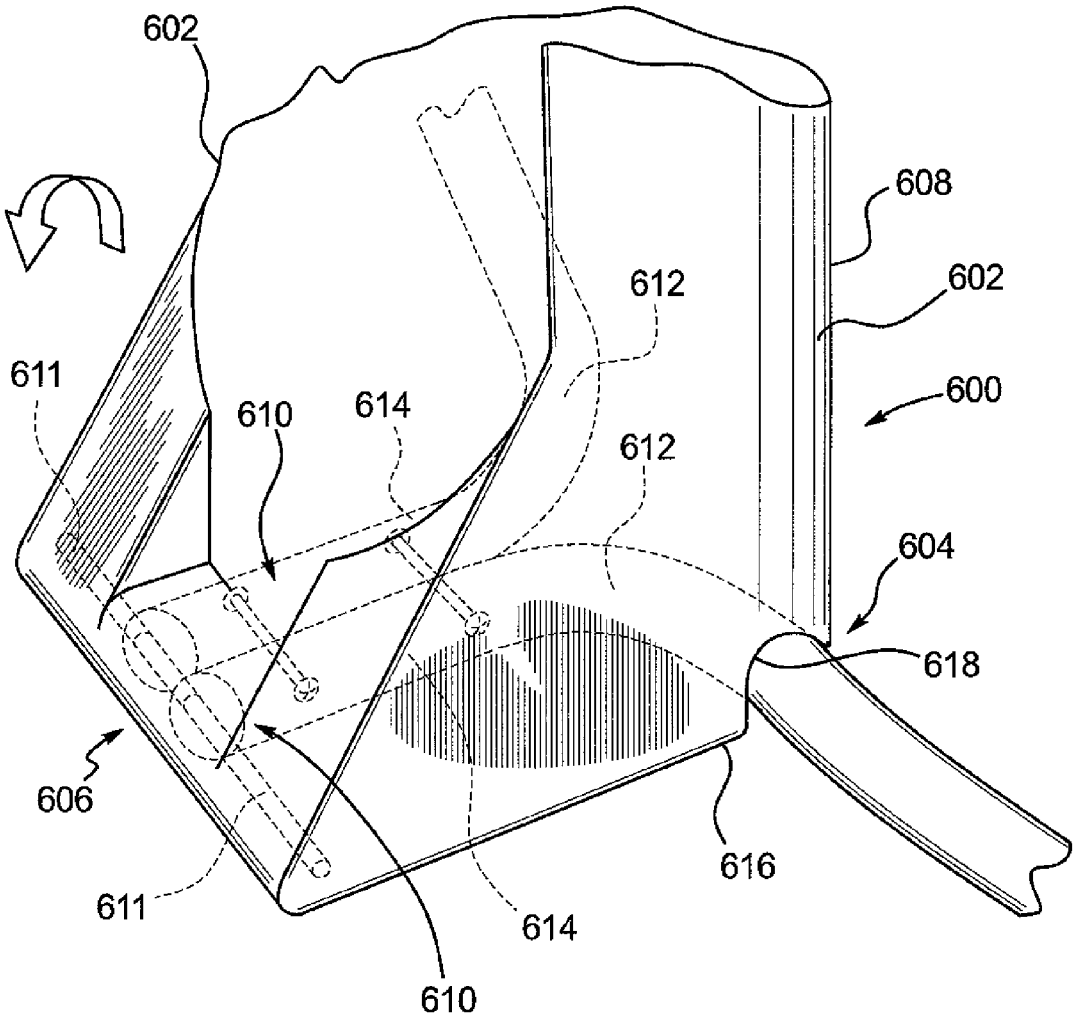
FIG. 15 is a partial cut-away view of another example of a foldable spine for a collapsible child motion device constructed in accordance with the teachings of the present invention.

FIG. 15 shows one of many possible alternative examples for a construction of a spine 600 with a housing 602 that can fold or pivot relative to a base section 604. The components in this example may equate generally to the example shown in FIGS. 11B and 12B, each of which has a housing that can pivot or fold relative to the base section parts coupled to it.

In this example, the housing 602 has a front side 606 and a rear side 608 relative to a position of its support arm (not shown) at mid-travel position. The base section 604 has a pair of ends 610 that are coupled to a pivot pin 611 within the front side 606 of the housing 602. The pivot axis of the pin 611 extends laterally side-to-side across the front side of the housing. The ends 610 extend rearward to the rear side 608 of the housing and then curve in opposite directions to opposed bent parts 612. Linear parts 614 of the ends 610 are side-by-side adjacent one another and fixed to one another within the housing to provide stability and rigidity for the base section 602. A bottom edge 616 of the housing 602 has a pair of notches 618 positioned and contoured to accommodate the location and shape of the oppositely extending bent parts 612, which seat within the notches when the device is in the in-use configuration as shown. When the device is to be folded or collapsed, the housing can be rotated forward about the pivot axis of the pin 611 to a position generally co-planar with the base section 604.

The details of the various child motion device examples disclosed herein can vary considerably and yet fall within the spirit and scope of the present invention. The construction and materials used to form the frame assembly parts, the spine parts, and the added features can vary from plastics, to steel tubing, to composites, other suitable materials and part structures. The drive system components can also vary, as can the features employed in the drive system to create desired motions and functions for the disclosed devices. The housing can have a top cap that rotates with and/or is integrally a part of the swing arm. Alternatively, the housing can provide a platform on the top or on a side of the spine such that the driven end of the support arm is supported by the platform and rotates relative to the platform.

The bottom or base of the various seats and other child supporting devices can be configured so as to engage with the seat holder in any suitable manner. As disclosed herein, vertical or vertically angled notches can be provided in the seat base. The size of the seat holder tubes or other materials can be configured to slip into the notches to engage with the seat. Gravity and the weight of a child can be enough to retain the seat in the holder. However, positive latching structures can be employed, if desired. The seat can also be configured to include common features such as a harness system, carrying handles, a pivotable tray, a hard plastic shell, and the like. The base of the seat can have a rocking, bouncing, or stationary support structure configuration and the seat can employ a pad, cover, or other suitable soft goods. As noted above, the seat holder can be configured to hold other child supporting devices such as a bassinet.

The seat can also be configured to mate within a platform or system of related products. In other words, the seat could be removable from one of the disclosed motion devices and readily placed in a different product that is configured to accept the seat. Such related products can be, for example, a cradle swing frame, a standard pendulum-type swing frame, a bouncer frame, a stroller, a car seat base, or an entertainment platform. In this way, the product system can be useful as a soothing or calming device when a child is young and then be transformed for use as an entertainment device as the child grows. In another example, the child seats could be fixed to the support arm or arms or otherwise not be removable.

Also, though not shown in detail herein, each foldable joint of the frame assemblies can have positive locking or detent mechanisms to retain or lock the devices in either or both the in-use and the folded configurations. The joints can be gear-type joints, a combination of spring biased locking pins, pivot joints and apertures, or other latching mechanisms. Alternatively, the devices disclosed herein need not be foldable at all, if desired, but instead can be constructed so that they can not be collapsed without disassembly of the components. Quick disconnect joints can be employed so that the device can be easily broken down for transport or storage. The seat holder can even be separately detachable and replaceable with other seat holders of different configuration to accommodate different child supporting devices, if desired.

The term "bounce mechanism" is used to generally identify the mechanisms or structures that bounce in any of the disclosed devices, including the flexible arms 220 in the device 200, the spring mechanism 80 and four-bar linkage of the device 20, and the spring 148 in the device 120. The term also encompasses motors and mechanical or electrical drivers that impart automatic bounce motion such as the motor 144 of the device 120. The term is not meant to refer to a child or a caregiver, whose actions may initiate a bouncing motion in a "bounce mechanism."

Although certain child motion devices have been described herein in accordance with the teachings of the present disclosure, the scope of coverage of this patent is not limited thereto. On the contrary, this patent covers all embodiments of the teachings of the disclosure that fairly fall within the scope of permissible equivalents.

What is claimed is:

1. A child motion device comprising:

a frame assembly configured to rest on a floor surface;

a bounce mechanism;

a support arm assembly coupled by a four-bar linkage arrangement to and cantilevered from part of the frame assembly above the floor surface; and a child supporting device supported by the support arm assembly, wherein the bounce mechanism is part of the support arm assembly and includes an adjustable spring mechanism configured to move the four-bar linkage arrangement; and wherein the bounce mechanism is employed to reciprocally bounce the child supporting device above the floor surface.

2. A child motion device according to claim 1, wherein the child supporting device is removably mounted on the support arm assembly.

3. A child motion device according to claim 1, wherein the frame assembly further comprises:

a base section that can be arranged to lie on the floor surface; and a spine that can be arranged to extend upward from the base section away from the floor surface and wherein the support arm is cantilevered from the spine.

4. A child motion device according to claim 3, wherein the base section and the support arm assembly are each reconfigurable to a folded condition lying closely spaced to and generally parallel to the spine in the folded condition.

5. A child motion device according to claim 1, wherein the child supporting device can be supported in a plurality of different child facing orientations including a first orientation facing the support arm assembly and a second orientation facing in the opposite direction away from the support arm assembly.

6. A child motion device according to claim 1, wherein the support arm assembly is configured to support a child supporting device that is selectable from an array of different child supporting device options and that is removable and replaceable on the support arm assembly.

7. A child motion device according to claim 1, wherein a frequency of bounce cycles is adjustable by a user.

8. A child motion device according to claim 1, wherein a bounce range of motion is adjustable by a user.

9. A child motion device according to claim 1, wherein the child supporting device is a removable seat configured to be readily secured for use in another device selected from a group consisting of a stroller, a pendulum swing, a bouncer, and a car seat.

10. A child motion device according to claim 3, wherein the base section and the spine are pivotally coupled to one another and can be folded to a condition lying generally parallel to one another.

11. A child motion device according to claim 1, wherein the support arm assembly can also pivotally reciprocate the child supporting device through a partial orbit around a generally vertical axis.

12. A child motion device according to claim 11, wherein the bounce mechanism includes a drive mechanism that can bounce and pivotally reciprocate the child supporting device.

13. A child motion device according to claim 1, wherein the bounce mechanism is responsive to an external force applied to the support arm assembly or to movement of an occupant of the child supporting device in order to impart the reciprocating bouncing motion.

14. A child motion device according to claim 1, wherein the bounce mechanism includes a drive mechanism operable to automatically and continuously impart the reciprocating bounce motion.

15. A child motion device according to claim 1, further comprising:

a touch pad device on a portion of the frame assembly and electronically coupled to the bounce mechanism to control the reciprocating bounce motion of the child supporting device.

16. A child motion device comprising:

a frame assembly having a base section configured to rest on a floor surface that lies in a generally horizontal reference plane and having an upright section extending upward from a part of the base section;

a bounce mechanism; and a support arm cantilevered radially outward from the upright section and coupled to the upright section by a four-bar linkage, the support arm being configured to support a child above the floor surface, wherein the bounce mechanism includes an adjustable spring mechanism is configured to move the four-bar linkage and impart a reciprocating bouncing motion to the child.

17. A child motion device according to claim 16, wherein the bounce mechanism generates the reciprocating bouncing motion upon movement of the child on the support arm or upon application of a force upon the support arm.

18. A child motion device according to claim 16, wherein the bounce mechanism includes a motor that automatically generates the reciprocating bouncing motion.

19. A child motion device according to claim 16, wherein the frame assembly is reconfigurable between an in-use condition and a more compact folded condition.

20. A child motion device according to claim 16, further comprising:

a child supporting device on the support arm and selected from an array of different child supporting device options and being removable from and replaceable on the support arm.

21. A child motion device according to claim 16, wherein the support arm can also pivotally reciprocate the child through a partial orbit around the upright section.

22. A child motion device comprising:

a frame configured to rest on a floor surface that lies in a generally horizontal reference plane;

a cantilevered arm with one end coupled via a four-bar linkage to a part of the frame and having a free end positioned above the floor surface, the free end of the support arm being moveable within a generally vertical plane;

an adjustable spring coupled to the four-bar linkage; and a child supporting device on the arm spaced above the floor surface, wherein the adjustable spring can bounce the free end of the support arm in a reciprocating path within the generally vertical plane to thereby bounce the child supporting device.

* * * * *